US011772250B2

(12) United States Patent
Hao et al.

(10) Patent No.: US 11,772,250 B2
(45) Date of Patent: Oct. 3, 2023

(54) NAIL GUN

(71) Applicant: Nanjing Chervon Industry Co., Ltd., Nanjing (CN)

(72) Inventors: Jingdong Hao, Nanjing (CN); Junliu Zhang, Nanjing (CN); Wei Zhang, Nanjing (CN); Xiangqing Fu, Nanjing (CN)

(73) Assignee: Nanjing Chervon Industry Co., Ltd., Nanjing (CN)

( * ) Notice: Subject to any disclaimer, the term of this patent is extended or adjusted under 35 U.S.C. 154(b) by 115 days.

(21) Appl. No.: 17/229,985

(22) Filed: Apr. 14, 2021

(65) Prior Publication Data

US 2021/0323131 A1 Oct. 21, 2021

(30) Foreign Application Priority Data

Apr. 16, 2020 (CN) ..... 202010301178.5
Feb. 4, 2021 (CN) ..... 202110152268.7

(51) Int. Cl.
*B25C 1/04* (2006.01)
*B25C 1/06* (2006.01)

(52) U.S. Cl.
CPC ..... *B25C 1/047* (2013.01); *B25C 1/041* (2013.01); *B25C 1/06* (2013.01)

(58) Field of Classification Search
CPC ..... B25C 1/041; B25C 1/047; B25C 1/06; B25C 7/00
See application file for complete search history.

(56) References Cited

U.S. PATENT DOCUMENTS

2011/0198381 A1* 8/2011 McCardle ..... B25C 1/047 227/8
2016/0288305 A1* 10/2016 McCardle ..... B25C 1/047
2017/0190037 A1* 7/2017 Sato ..... B25C 1/06
2019/0126452 A1* 5/2019 Po ..... B25C 1/042
2019/0126453 A1* 5/2019 Po ..... B25C 1/047
2019/0375084 A1 12/2019 Bierdeman et al.
2020/0164498 A1* 5/2020 Wechselberger ..... B25C 1/047
2020/0230791 A1* 7/2020 Pomeroy ..... B25C 1/008
2020/0282534 A1* 9/2020 Po ..... B25C 1/06
2020/0338708 A1* 10/2020 Po ..... B25C 1/047
2020/0346333 A1* 11/2020 Po ..... B25C 1/008
2021/0308852 A1* 10/2021 Ueda ..... B25C 1/047

FOREIGN PATENT DOCUMENTS

DE 202019103401 U1 6/2019
EP 3517250 A1 7/2019

OTHER PUBLICATIONS

EPO, extended European search report issued on European publication No. 3904008, dated Oct. 1, 2021, 7 pages.

* cited by examiner

*Primary Examiner* — Joshua G Kotis
(74) *Attorney, Agent, or Firm* — Greenberg Traurig, LLP

(57) ABSTRACT

A nail gun includes a housing, a power output assembly, a cylinder, and a firing assembly. At least a part of the power output assembly is disposed in the housing. At least a part of the cylinder is disposed in the housing. The firing assembly includes a firing pin provided with a first drive teeth capable of being driven, the first drive teeth includes a locking tooth provided with a rotating shaft, the rotating shaft is provided with a roller wheel, and the roller wheel is rotatable about a rotating axis.

19 Claims, 18 Drawing Sheets

NAIL GUN

RELATED APPLICATION INFORMATION

This application claims the benefit under 35 U.S.C. § 119(a) of Chinese Patent Application No. CN 202010301178.5, filed on Apr. 16, 2020, and Chinese Patent Application No. CN 202110152268.7, filed on Feb. 4, 2021, which are incorporated by reference in their entirety herein.

BACKGROUND

A nail gun serves as a nailing tool. Existing nail gun products on the market may be classified into mechanical-type nail guns and cylinder-type nail guns according to a mode of principles. The mechanical-type nail guns may be classified into structures such as spring-type nail guns, flywheel-type nail guns, friction pulley-type nail guns according to a mode of energy storage. The cylinder-type nail guns may be classified into single cylinder nail guns or double cylinder nail guns according to the number of cylinders and nail guns which store energy with a positive pressure or nail guns which store energy with a negative pressure according to the mode of energy storage. In the existing art, the cylinder-type nail guns have a complex structure and a relatively large volume and are quite inconvenient for a user to operate. Therefore, how to provide a compact and easy-to-operate cylinder-type nail gun is an urgent technical problem to be solved currently.

SUMMARY

In one aspect of the disclosure, a nail gun includes a housing, a power output assembly, a cylinder, a power output assembly, and a firing pin. At least a part of the power output assembly is disposed in the housing, at least a part of the cylinder is disposed in the housing, the firing pin is configured to perform nailing, the firing pin is provided with a first drive teeth capable of being driven, the first drive teeth includes a locking tooth provided with a rotating shaft, the rotating shaft is provided with a roller wheel, and the roller wheel is rotatable about a rotating axis.

In one example, a radius of the roller wheel is greater than or equal to a length of a connecting line between a tooth crest of the locking tooth and an axis center of the rotating shaft.

In one example, the rotating shaft is rotatably connected to the locking tooth, and the roller wheel is fixedly connected to the rotating shaft and capable of rotating with the rotating shaft synchronously.

In one example, the rotating shaft is rotatably connected to the locking tooth, and the roller wheel is rotatably connected to the rotating shaft and capable of rotating with the rotating shaft synchronously.

In one example, the rotating shaft is fixedly connected to the locking tooth, and the roller wheel is rotatably connected to the rotating shaft and capable of rotating about the rotating shaft.

In one example, the power output assembly has a first symmetry plane, the cylinder has a second symmetry plane, and the first symmetry plane is substantially parallel to the second symmetry plane, and a distance between the first symmetry plane and the second symmetry plane is greater than or equal to 0 and less than or equal to 15 mm.

In one example, the power output assembly includes a motor and a gearbox, the motor is configured to output a driving force to the gearbox, the gearbox is provided with a drive shaft capable of driving the firing pin to move, the nail gun further includes a drive member disposed between the firing pin and the drive shaft, the drive member includes second drive teeth for engaging with the first drive teeth of the firing pin, and the second drive teeth extends in an extension plane parallel to or coincident with the first symmetry plane.

In one example, a distance between the extension plane and the first symmetry plane is greater than or equal to 0 and less than or equal to 10 mm.

In one example, a radius of the cylinder is configured to be greater than or equal to 21 mm and less than or equal to 24 mm, and a volume of the cylinder is configured to be greater than or equal to 180 ml and less than or equal to 260 ml.

In one example, the firing pin includes a piston disposed in the cylinder, and a stroke of the piston in the cylinder is greater than or equal to 82 mm and less than or equal to 105 mm.

In one example, the rotating axis is perpendicular an extension direction of the firing pin.

In one example, the roller wheel is disposed on the one of the first drive teeth farthest from the cylinder.

In one example, the nail gun includes two ones of the roller wheel, and the two ones of the roller wheel are respectively arranged on two sides of the locking tooth.

In one example, the nail gun further includes a drive member disposed between the firing pin and the power output assembly, and the drive member includes second drive teeth for engaging with the first drive teeth of the firing pin.

In one example, the drive member further includes a release portion for releasing the firing pin to move towards the cylinder, and the release portion and the second drive teeth are disposed on a circumference of the driving member.

In one aspect of the disclosure, a nail gun includes a housing, a power output assembly, a cylinder, a firing pin, and a drive member. The housing is formed with a first accommodating space and a second accommodating space, at least a part of the power output assembly is disposed in the first accommodating space, at least a part of the cylinder is disposed in the second accommodating space, the firing pin is configured to perform nailing, the drive member is configured to drive the firing pin, the firing pin is provided with a first drive teeth capable of being driven and further provided with a rotating shaft provided with a roller wheel, the roller wheel is capable of rotating about a rotating axis, and the drive member includes a second drive teeth capable of being engaged with the roller wheel.

In one example, the nail gun further includes a connecting base connected to the cylinder, the connecting base is provided with a first through hole through which the firing pin passes and further provided with exhaust ports for discharging gas, and the exhaust ports are distributed around the connecting base.

In one example, the cylinder and the connecting base are connected to each other such that a first space and a second space capable of being divided into by the piston are formed, and the exhaust ports are disposed in the second space.

In one example, a radius of the roller wheel is greater than or equal to a length of a connecting line between a tooth crest of a locking tooth and an axis center of the rotating shaft.

In one example, the drive member is configured to rotate about a axis parallel to the rotating axis, and the rotating axis is perpendicular an extension direction of the firing pin.

DETAILED DESCRIPTION

Figure 1:
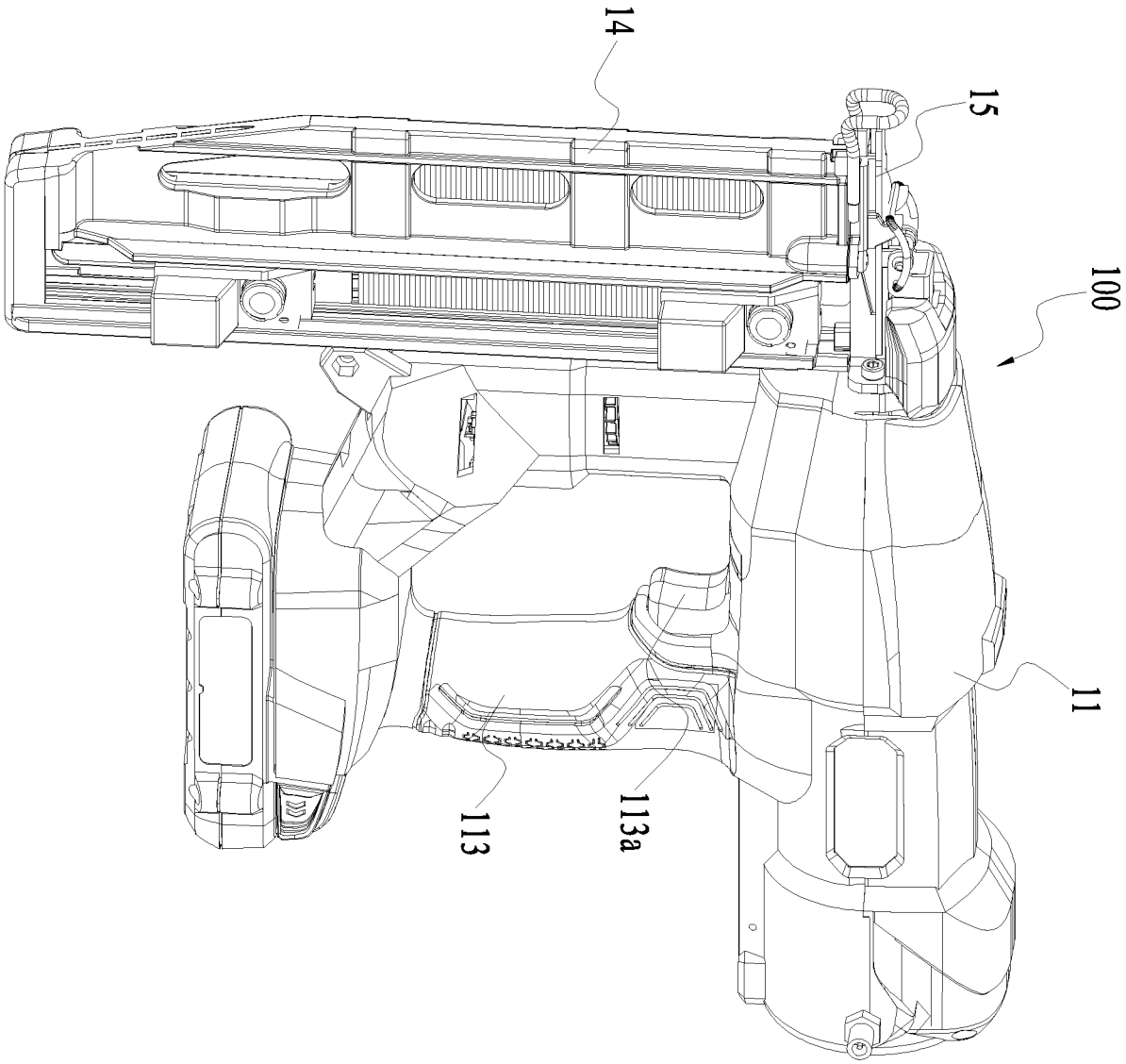
FIG. 1 is a perspective view of a nail gun according to a first example.
Figure 2:
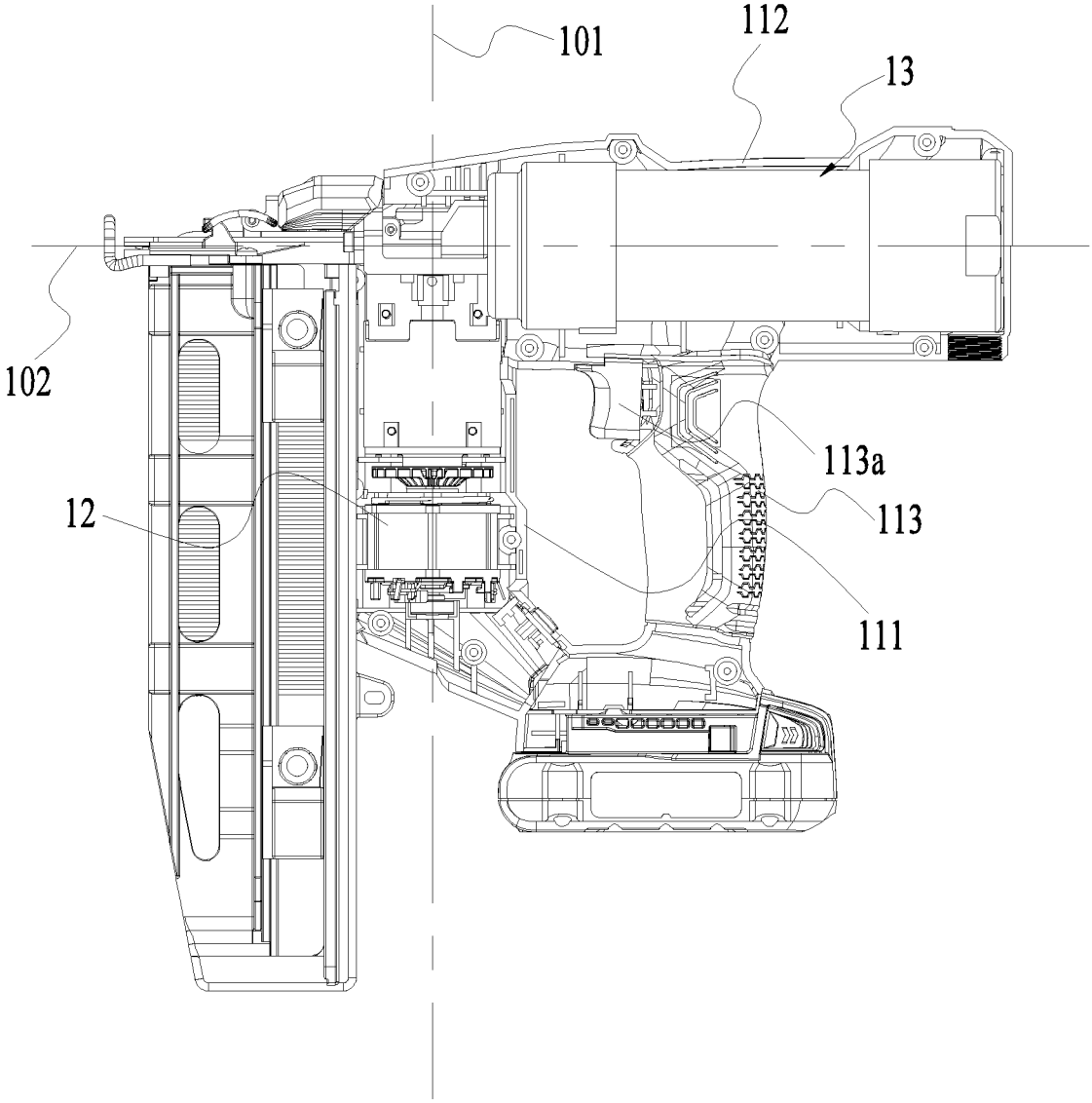
FIG. 2 is a sectional view of the nail gun of FIG. 1.

A nail gun 100 shown in FIGS. 1 and 2 includes a housing 11, a power output assembly 12, a cylinder 13, and a cartridge assembly 14. The housing 11 includes a first accommodating space 111 extending in a direction of a first straight line 101 and a second accommodating space 112 extending in a direction of a second straight line 102. The power output assembly 12 is disposed in the first accommodating space 111, and the cylinder 13 is disposed in the second accommodating space 112. A firing assembly 15 is disposed in the cylinder 13, and air in the cylinder 13 does work so as to push the firing assembly 15 to move to fire a nail. The cartridge assembly 14 is configured to store nails which can be fired by the firing assembly 15. The housing 11 is further formed with a handle portion 113 for being held by a user. One end of the handle portion 113 is connected to a power interface for accessing a direct current power supply or an alternating current power supply. The handle portion 113 is provided with a main switch 113*a*, and the user controls the start and stop of the nail gun 100 through the main switch 113*a*. In this example, the power interface is connected to a battery pack.

Figure 3:
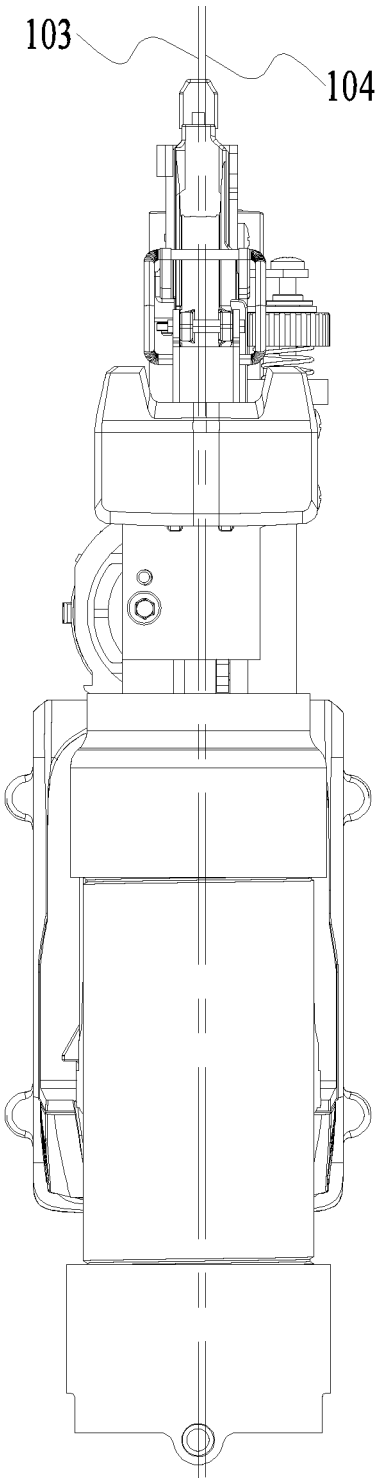
FIG. 3 is a top view of the nail gun of FIG. 1.

As shown in FIGS. 1 to 3, the power output assembly 12 has a first symmetry plane 103 and is disposed substantially symmetrically about the first symmetry plane 103. The cylinder 13 has a second symmetry plane 104 and is disposed substantially symmetrically about the second symmetry plane 104. The first symmetry plane 103 is substantially parallel to or coincident with the second symmetry plane 104. In an implementation, a preset distance L is provided between the first symmetry plane 103 and the second symmetry plane 104, where L is greater than or equal to 0 and less than or equal to 15 mm. In an implementation, L is greater than or equal to 0 and less than or equal to 14 mm, or L is greater than or equal to 0 and less than or equal to 13 mm. In fact, L may be further set to 12 mm, 11 mm, 10 mm or any value less than or equal to 10 mm. As shown in FIGS. 1 to 4, the nail gun 100 further provides a drive member 16 which enables the first symmetry plane 103 of the power output assembly 12 and the second symmetry plane 104 of the cylinder 13 to be substantially coincident with each other or be within a preset distance range. The drive member 16 is described below in detail.

Figure 4:
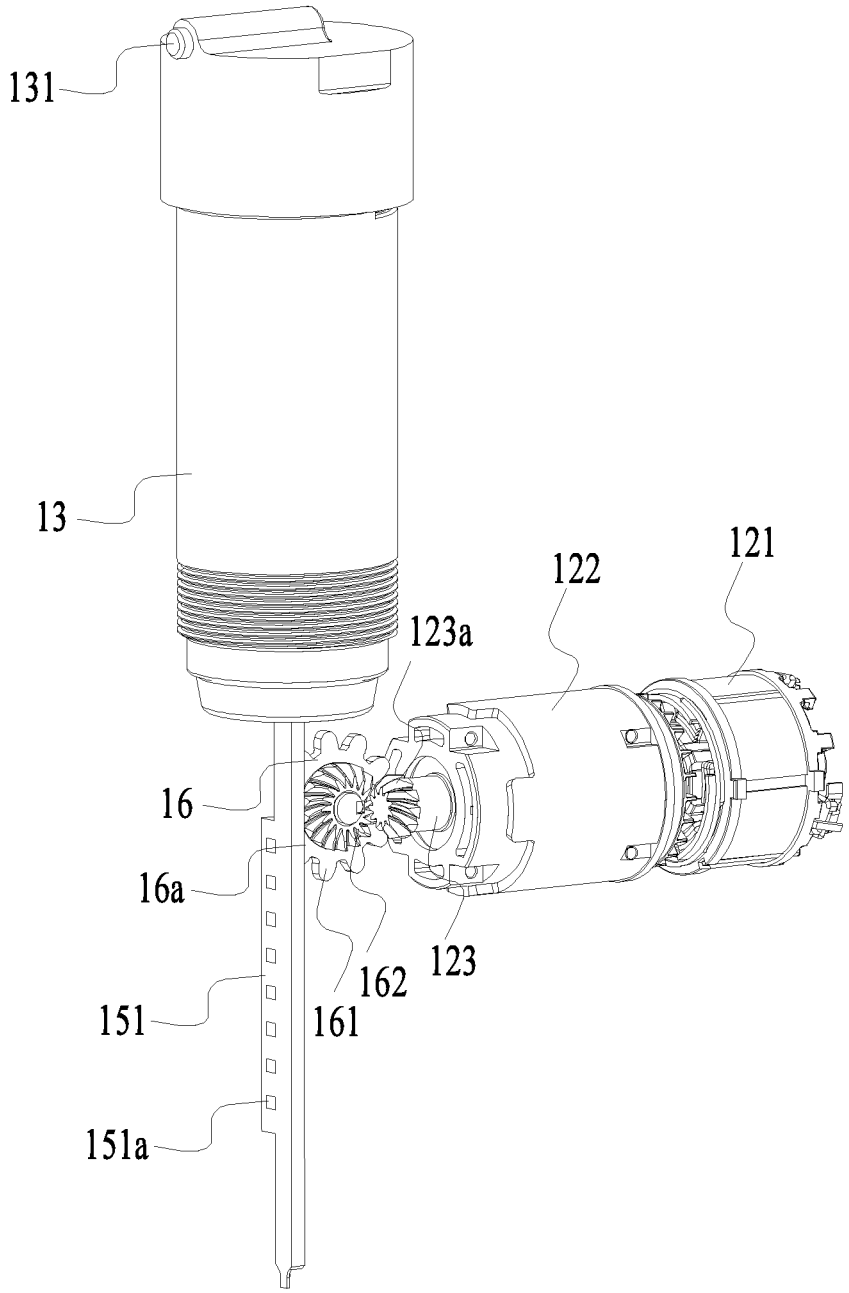
FIG. 4 is a perspective view illustrating a power output assembly and a cylinder of the nail gun of FIG. 1 being engaged with each other.

As shown in FIGS. 3 and 4, the power output assembly 12 includes a motor 121, a gearbox 122, and a drive shaft 123 connected to the gearbox 122, where the motor 121 outputs a driving force to the gearbox 122, and the gearbox 122 transmits the driving force to the drive shaft 123. The drive member 16 is further provided between the firing assembly 15 and the drive shaft 123. The drive member 16 is capable of driving the firing assembly 15 to fire nails. With the above configuration, in a width direction perpendicular to the first symmetry plane 103 or the second symmetry plane 104, the power output assembly 12, a handle, and the drive member 16 of the nail gun 100 occupy a smaller size in the width direction so that an overall structure of the nail gun 100 is more compact and convenient to operate by the user.

In an implementation, the firing assembly 15 includes a firing pin 151 capable of being driven, the firing pin 151 is formed with first drive teeth 151*a* capable of being driven, and the drive member 16 is formed with second drive teeth 161 capable of being engaged with the first drive teeth 151*a*. When the first drive teeth 151*a* are engaged with the second drive teeth 161 and drive the firing pin 151 to move, air in the cylinder 13 is compressed such that a next nailing cycle is entered. In fact, the drive shaft 123 is formed with first transmission teeth 123*a*, the drive member 16 is further formed with second transmission teeth 162 to be engaged with the first transmission teeth 123*a*, and the second transmission teeth 162 can mesh with the first transmission teeth 123*a* so as to transmit the driving force from the gearbox 122. The first transmission teeth 123*a* and the second transmission teeth 162 adopt a group of bevel gear structures, so that a transmission direction of the driving force can be changed and the size of the nail gun 100 in the width direction is not increased due to the existence of the drive member 16.

The second drive teeth 161 extend in an extension plane. The extension plane is substantially parallel to or coincident with the first symmetry plane 103 or the second symmetry plane 104. In an implementation, a distance between the extension plane and the first symmetry plane 103 and a distance between the extension plane and the second symmetry plane 104 are greater than or equal to 0 and less than or equal to 10 mm.

Figure 5:
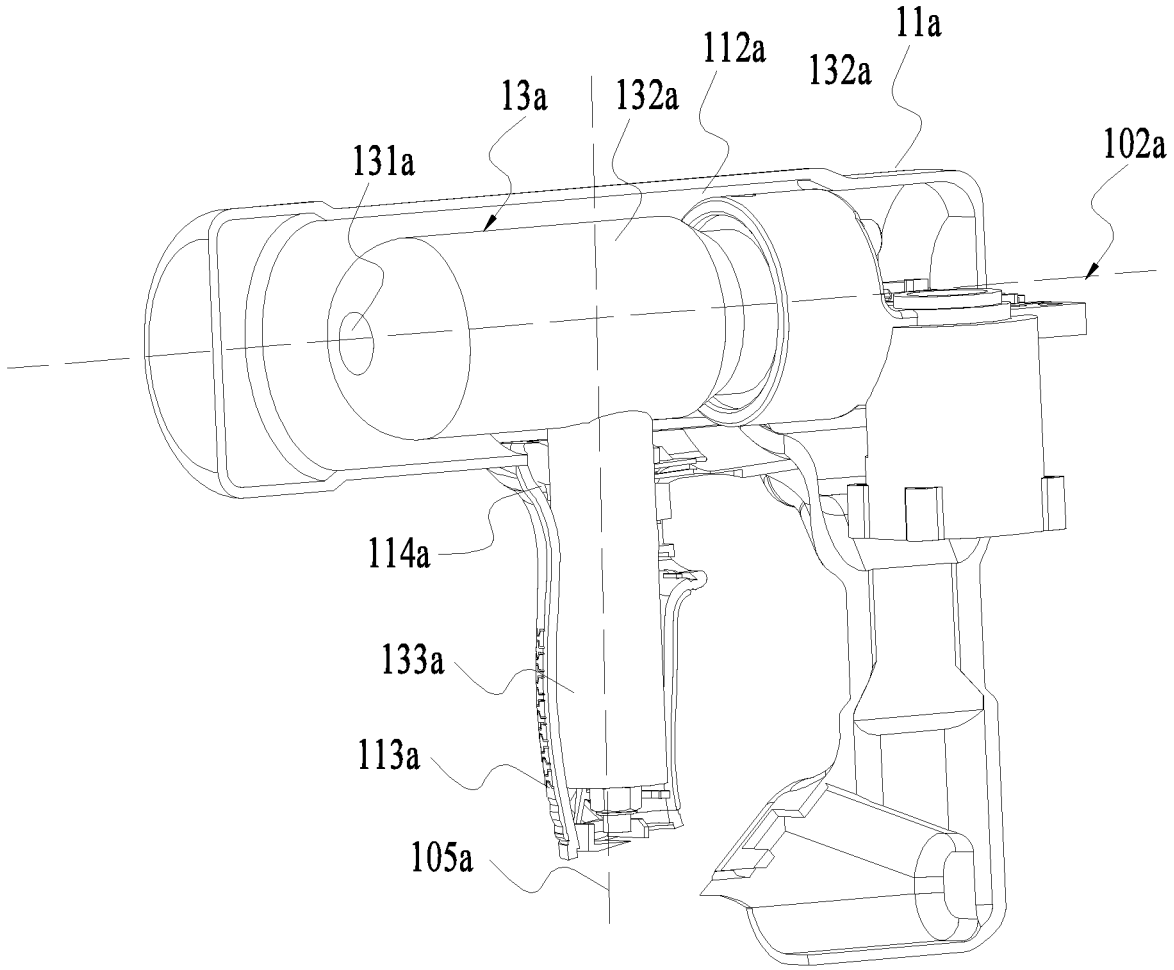
FIG. 5 is a sectional view of a cylinder of a nail gun according to example a second example.

FIG. 5 shows a partial structure of a nail gun of the second example. The structure of the nail gun of the first example that can be applied to the present example is applied to the present example, which will not be described in detail, and the differences between the present example and the first example will be mainly described below. The cylinder 13*a* includes an aeration nozzle 131*a* for inflating air into the cylinder 13*a* in advance. When air with a certain pressure is pre-inflated into the cylinder 13*a*, the drive member drives the firing assembly to compress the air and the air does work, so that an accelerated speed is provided when a nail is fired, thereby enabling the firing assembly to have a relatively large striking force. It is to be understood that the cylinder 13*a* is disposed within a preset space range due to limitation of a volume of the nail gun. In this implementation, a scheme of a cylinder 13*a* with a large volume on the premise that the volume of the nail gun is not increased is further provided. Specifically, the cylinder 13*a* includes a main body portion 132*a* disposed in the second accommodating space 112*a* and a special-shaped portion 133*a* disposed in a space of the handle. The special-shaped portion 133*a* is a part of the cylinder 13*a* and in at least partial communication with the main body portion 132*a*. It is to be understood that the handle portion 113*a*, as a component capable of being held by the user to operate the nail gun, is provided with certain structural strength, and in order to facilitate control of the nail gun by the user, the handle portion 113*a* is further provided with a small number of traces and a control component. Therefore, the handle portion 113*a* actually has a third accommodating space 114*a* for accommodating the special-shaped portion 133*a* of the cylinder 13*a*. The second accommodating space 112*a* is in at least partial communication with the third accommodating space 114*a*. The special-shaped portion 133*a* is configured to be distributed substantially along the course of an inner space of the handle portion 113*a*. Optionally, the special-shaped portion 133*a* is further configured to extend substantially along a direction of a third straight line 105*a*. The direction of the third straight line 105*a* intersects the direction of the second straight line 102*a*. In an implementation, the main body portion 132*a* and the special-shaped portion 133*a* of the cylinder 13*a* may be individually formed and then formed as a whole by welding or may be integrally formed. The special-shaped portion 133*a* is provided such that a space in the interior of the housing 11*a* of the nail gun can be effectively utilized and the space of the cylinder 13*a* is increased. In this manner, the cylinder 13*a* can accommodate more air and a greater striking force can be output in a process of doing work to the outside by the air in the cylinder 13*a*. In fact, the special-shaped portion 133*a* is provided such that the main body portion of the cylinder 13*a* can occupy a smaller space in the second accommodating space 112*a* on the premise that the nail gun has a certain striking force. In this manner, a size occupied by the housing in the direction of the second straight line 102*a* can be shortened, the nail gun is more compact as a whole, and operation experience of the user is better. In fact, in some optional implementations, a ratio of a volume of the main body portion 132*a* to a volume of the special-shaped portion 133*a* is greater than or equal to 0.5 and less than 2, so that the space occupied by the main body portion 132*a* is smaller.

In an example, the cylinder may further be configured to be a two-layer cylinder structure composed of an inner-layer cylinder and an outer-layer cylinder. It is to be understood that when the two-layer cylinder is provided, air in the inner-layer cylinder and air in the outer-layer cylinder are in communication. When the firing assembly disposed in the inner-layer cylinder is driven to compress the air or the air does work to drive the firing assembly, the firing assembly has a relatively small contact area with the air in the cylinder so that a change of a pressure value of the air in the cylinder is relatively small. In this manner, the striking force output by the air in the cylinder is relatively stable, which also makes the nail gun provide a better operation experience.

Figure 6:
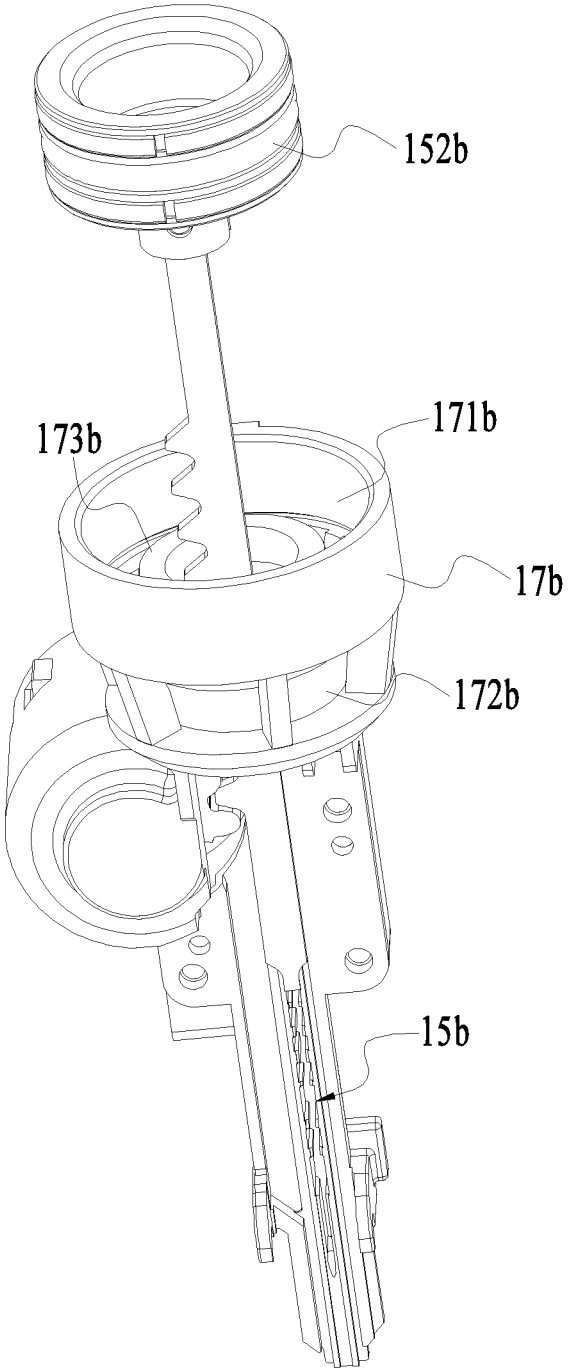
FIG. 6 is a perspective view illustrating a connecting base and a firing assembly of a nail gun being in a first engaged state according to a third example.
Figure 7:
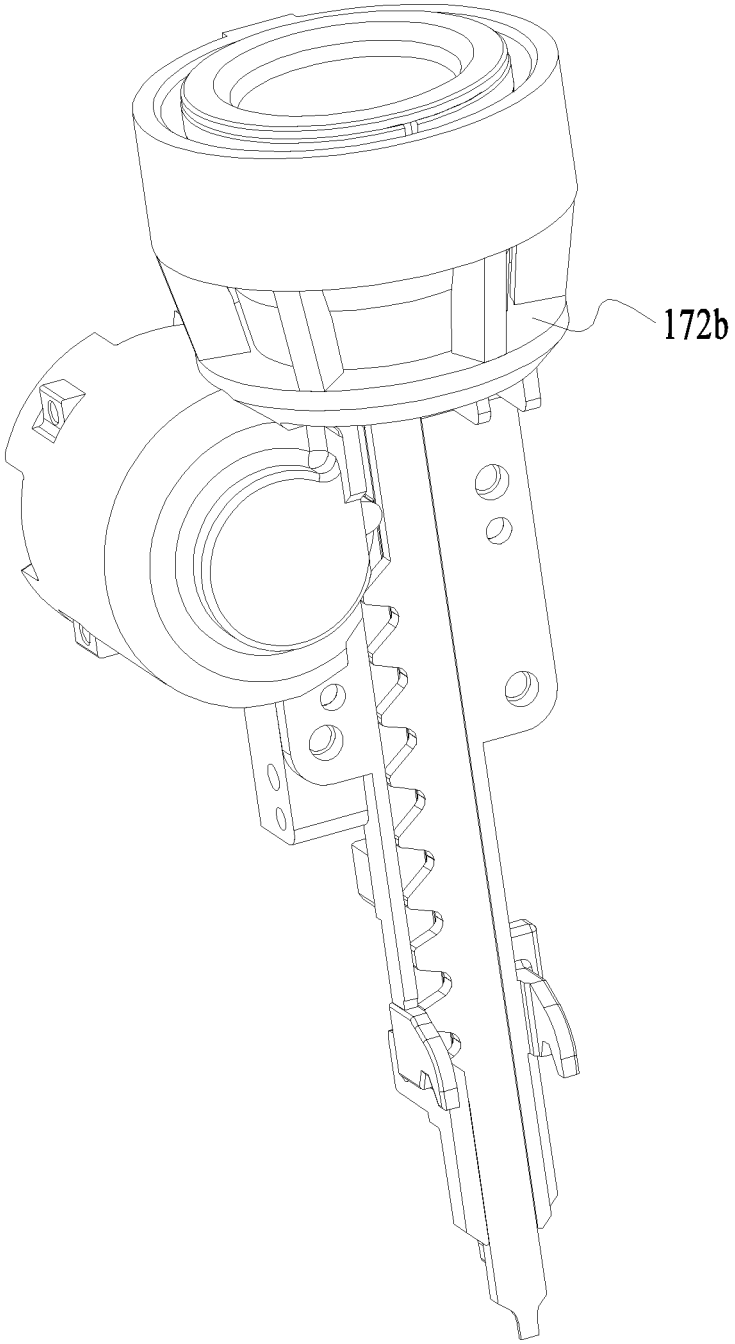
FIG. 7 is a perspective view illustrating the connecting base and the firing assembly of a nail gun of FIG. 6 being in a second engaged state.
Figure 8:
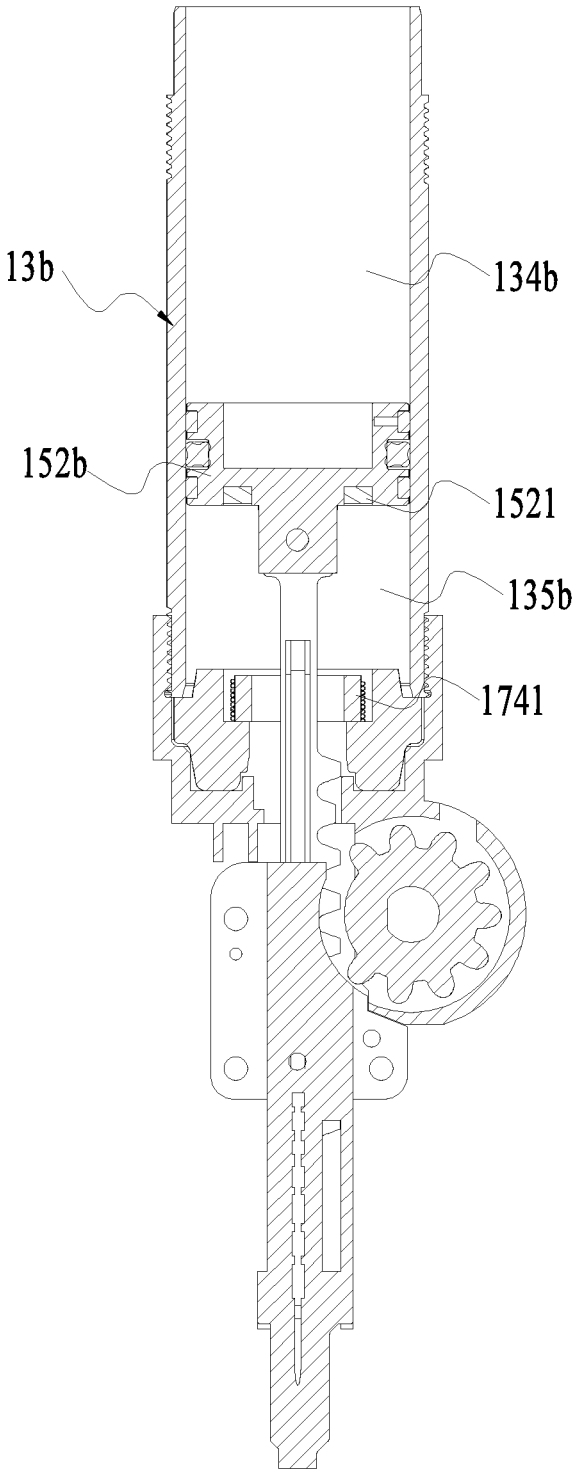
FIG. 8 is a sectional view of a connecting base and a firing assembly of a nail gun of FIG. 7.

FIGS. 6 and 7 show a partial structure of a nail gun of the third example. The structure of the nail gun of the first example that can be applied to the present example is applied to the present example, which will not be described in detail, and the differences between the present example and the first example will be mainly described below. As shown in FIGS. 6 to 8, the nail gun further includes a connecting base 17*b* capable of being connected to the cylinder 13*b*. Specifically, the connecting base 17*b* is formed with an internal thread structure, the cylinder 13*b* is formed with an external thread structure, and the internal thread structure and the external thread structure cooperate with each other so that the connecting base 17*b* and the cylinder 13*b* are detachably connected to each other. The firing assembly 15 includes a piston 152*b* that can cooperate with the cylinder 13*b*, and the connecting base 17*b* is formed with a first through hole 171*b* through which the firing assembly 15 can pass. In fact, an opening of the cylinder 13*b* through which the piston 152*b* passes is in communication with the first through hole 171*b*, that is, after the cylinder 13*b* is connected to the connecting base 17*b*, the cylinder 13*b* and the connecting base 17*b* form a penetrating whole, so that the piston 152*b* can move within an interval range of the penetrating whole. In fact, the penetrating whole formed by the cylinder 13*b* and the connecting base 17*b* is divided by the piston 152*b* and includes a first space 134*b* and a second space 135*b*. The first space 134*b* is a relatively enclosed space formed at the side of the piston 152*b* facing towards the cylinder 13*b*. It is to be understood that the first space 134*b* is closed by the piston 152*b*. The second space 135*b* is a relatively open space formed at the side of the piston 152*b* facing towards the connecting base 17*b*. When the piston 152*b* moves from the second space 135*b* to the first space 134*b*, air in the first space 134*b* is compressed; and when the firing assembly 15 is released, the air in the first space 134*b* does work to the outside such that the piston 152*b* is pushed to cause the firing assembly 15 to fire nails. Meanwhile, air in the second space 135*b* is rapidly compressed and needs to be quickly discharged, so as to avoid the air in the second space 135*b* from being compressed and avoid generating a reaction force on the piston 152*b*, thereby avoiding reducing the striking force of the firing assembly 15. Meanwhile, since the air in the second space 135*b* is rapidly discharged, friction or vibration is produced by the air and a discharge port, thus generating large noise.

In an implementation, the connecting base 17*b* is provided with exhaust ports 172*b* for quickly discharging the air in the second space 135*b*. The exhaust ports 172*b* are evenly distributed around a lower end of the connecting base 17*b*, and when the piston 152*b* moves to the connecting base 17*b*, a preset gap is further provided between the piston 152*b* and the exhaust ports 172*b*. In some optional implementations, a ratio of an area occupied by the exhaust ports 172*b* to an area of the piston 152*b* is greater than or equal to 0.25. In fact, the connecting base 17*b* is further provided with a buffer 173*b*. When the piston 152*b* moves to the connecting base 17*b* at a high speed, the piston 152*b* is in contact with the buffer 173*b* so that part of kinetic energy is counteracted, thereby preventing the piston 152*b* or the connecting base 17*b* from being damaged due to direct collision between the piston 152*b* and the connecting base 17*b*.

As shown in FIG. 8, the piston 152*b* is provided with a first magnetic member 1521, and the buffer 173*b* is provided with a second magnetic member 1741. The same magnetic poles of the first magnetic member 1521 and the second magnetic member 1741 are disposed facing each other. When the piston 152*b* rapidly moves to the buffer 173*b*, due to the buffer function of the magnetic force between the first magnetic member 1521 and the second magnetic member 1741, a large reaction force is generated between the piston 152*b* and the buffer 173*b*, and thereby the speed of the piston 152*b* is rapidly reduced to be within a preset range, and the collision between the piston 152*b* and the buffer 173*b* is alleviated. It is to be understood that the magnetic force between the first magnetic member 1521 and the second magnetic member 1741 are configured within a preset range, and the magnetic force does not affect the striking force of the firing assembly 15 when the firing assembly 15 fires the nail. When the first magnetic member 1521 and the second magnetic member 1741 are provided, the requirement for the buffer function of the buffer 173*b* is reduced due to the buffer function generated by the magnetic force, so that the buffer 173*b* can be designed thinner and thereby materials are saved. In addition, due to the buffer function of the first magnetic member 1521 and the second magnetic member 1741, the speed of the piston 152*b* has been reduced when the piston 152*b* moves to a position close to the buffer 173*b*, and a friction function between the piston 152*b* and the air in the second space 135*b* is reduced, so that influence caused by the noise is reduced, thereby reasonably solving the noise problem of the nail gun during a nailing process.

Figure 9:
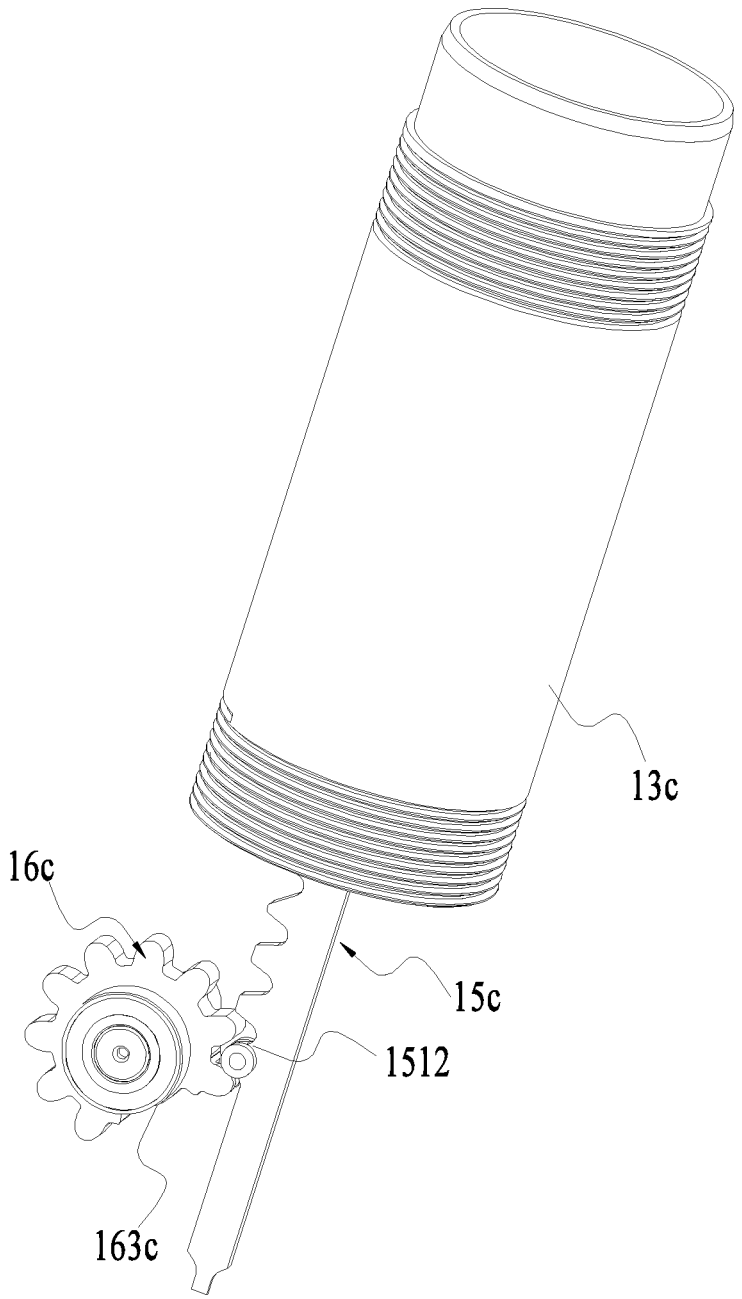
FIG. 9 is a perspective view of a firing assembly and a drive member of a nail gun according to a fourth example.
Figure 10:
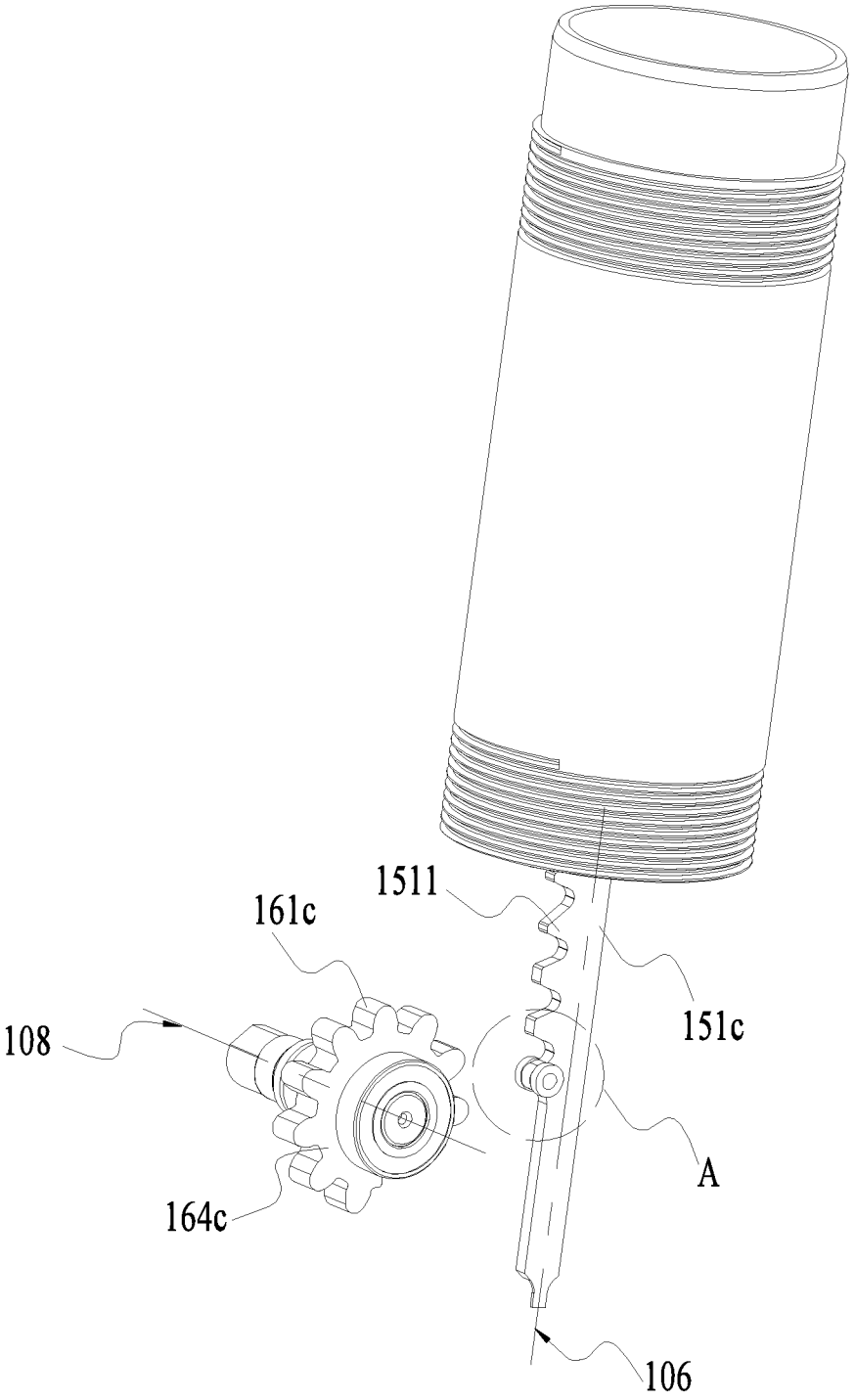
FIG. 10 is a perspective view illustrating a firing assembly and a drive member of a nail gun of FIG. 9 being separated from each other.
Figure 11:
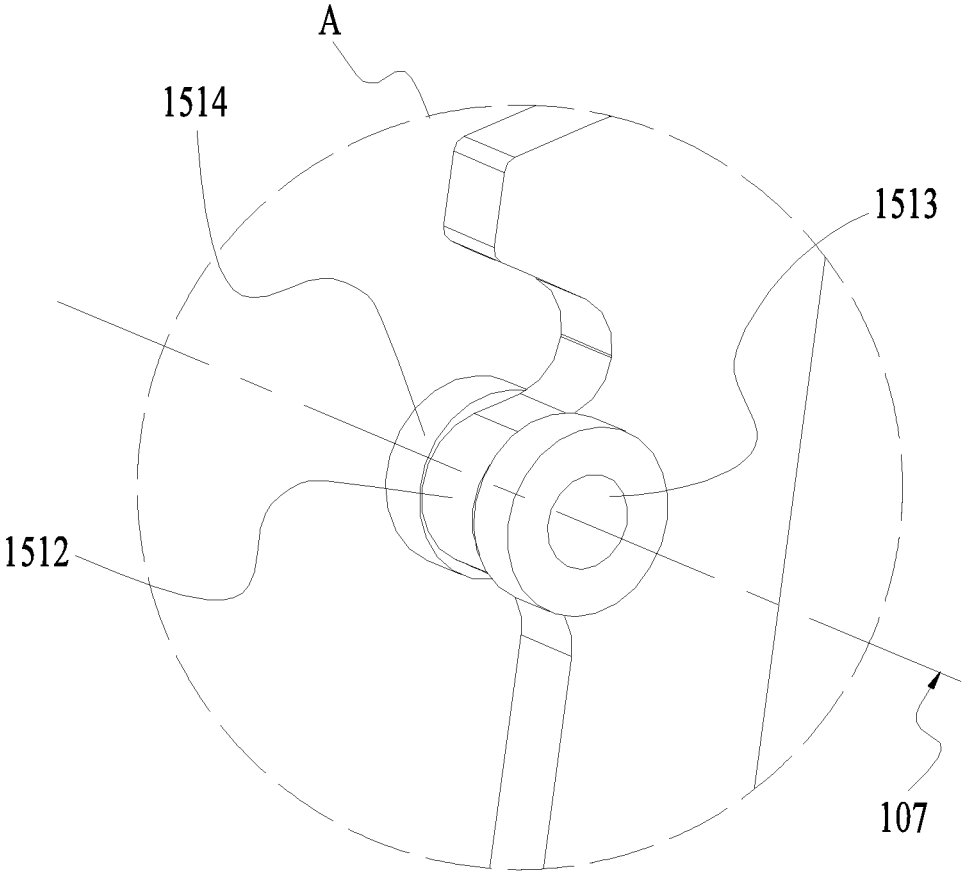
FIG. 11 is a partial enlarged view of part A of a nail gun of FIG. 10.

FIGS. 9 to 11 show a partial structure of a nail gun of the fourth example. The structure of the nail gun of the first example that can be applied to the present example is applied to the present example, which will not be described in detail, and the differences between the present example and the first example will be mainly described below. As shown in FIGS. 9 to 11, when the first drive teeth 151*a* of the firing pin 151*c* meshes with the second drive teeth 161*c* of the drive member 16*c*, the drive member 16*c* can drive the firing assembly 15*c* to compress the air in the cylinder 13*c* to do work, thereby enabling the nail gun to enter a next nailing cycle. In an implementation, the drive member 16*c* includes a drive portion 164*c* provided with the second drive teeth 161*c* and a release portion 163*c* provided as a circumferential portion which is continuously distributed. The release portion 163*c* for releasing the firing pin 151*c* to move towards the cylinder 13*c*, and the release portion 163*c* and the second drive teeth 161*c* are disposed on a circumference of the driving member 16*c*. The drive portion 164*c* is configured to drive the firing assembly 15*c* to compress the air in the cylinder 13*c*, and the release portion 163*c* is provided for the air in the cylinder 13*c* to do work to the outside such that the firing assembly 15*c* is driven to fire the nail. When the drive member 16*c* rotates in a first direction to drive the firing assembly 15*c* to move until a last tooth of the second driving teeth 161*c* meshes with a tooth at a lowermost end of the first driving teeth 1511, the nail gun enters a to-be-fired stage. At this time, if the drive member 16*c* continues to rotate, the drive member 16*c* rotates to a position where the release portion is opposite to the firing pin 151*c* to the release portion 163*c*, and the second drive teeth 161*c* is separated from the first drive teeth tooth 151*a* at this time. Here, the tooth at the lowermost end of the first driving teeth 1511 is defined as a locking tooth 1512, and the locking tooth 1512 is farthest from the cylinder 13. When the nail gun is in the to-be-fired stage, the last tooth of the second drive teeth 161*c* meshes with the locking tooth 1512 through merely one contact surface, and the meshing between the last tooth of the second drive teeth 161*c* and the locking tooth 1512 is not the meshing between gears in the true sense. In this case, since the locking tooth 1512 needs to bear a force accumulated in the cylinder 13*c* in a to-be-fired state of the nail gun, and a process in which the last tooth of the second driving teeth 161*c* performs rolling friction with the locking tooth 1512 exists at the moment of firing, the wear of the locking tooth 1512 is further increased. In an implementation, the locking tooth 1512 is provided with a rolling friction member.

Specifically, as shown in FIGS. 10 to 11, the rolling friction member includes a rotating shaft 1513 disposed on the locking tooth 1512 and a roller wheel 1514 connected to the rotating shaft 1513. The rotating shaft 1513 and the first drive teeth 151*a* are fixedly connected to each other or integrally formed. The rotating shaft 1513 is disposed on two sides of a tooth surface of the first drive teeth 151*a*, and the roller wheel 1514 is freely rotatable about the rotating shaft 1513. The nail gun 100 includes two ones of the roller wheel 1514, and the two ones of the roller wheel 1514 are respectively arranged on two sides of the locking tooth 1512. More specifically, a radius of the roller wheel 1514 is greater than or equal to a length of a connecting line between a tooth crest of the locking tooth 1512 and an axis center of the rotating shaft 1513. Therefore, when the nail gun is in the to-be-fired state, the last tooth of the second drive teeth 161*c* actually meshes with the roller wheel 1514 and a force is produced through pressing between the roller wheel 1514 and the last tooth. When the nail gun is in the to-be-fired state, rolling friction is generated between the last tooth of the second drive teeth 161*c* and the roller wheel 1514 so that the interaction force between the last tooth and the roller wheel 1514 is greatly reduced and the wear of the locking tooth 1512 is alleviated. In an implementation, the locking tooth 1512 is not limited to the tooth at the lowermost end of the first drive teeth 151*a* and may further be provided at any position of the first driving teeth 1511, and a position of the locking tooth 1512 is not limited here.

The firing pin 151*c* is extending along a line 106, the roller wheel 1514 may rotate about a rotating axis 107, and the rotating axis 107 is perpendicular the line 106. The drive member 16*c* is configured to rotate about an axis 108 parallel to the rotating axis 107.

It is to be understood that the firing pin 151*c* may also not be provided the locking tooth and merely be provided with a connecting portion for connecting the rotating shaft to the roller wheel, so that the locking of the first drive teeth can also be achieved, and the rolling friction between the roller wheel and the first drive teeth can be achieved. More specifically, the rotating shaft may be provided to be rotatably connected to the connecting portion so that the roller wheel can rotate synchronously with the rotating shaft when the roller wheel is mounted to the rotating shaft. Alternatively, the rotating shaft is fixedly connected to the connecting portion, and the roller wheel is rotatably connected to the rotating shaft and is freely rotatable about the rotating shaft.

The single-layer cylinder 13*c* may be used as the cylinder 13*c*. When a radius of the cylinder 13*c* is configured to be greater than or equal to 21 mm and less than or equal to 24 mm and a volume of the cylinder 13*c* is configured to be greater than or equal to 180 ml and less than or equal to 260 ml, a stroke of the piston in the cylinder 13*c* is configured to be greater than or equal to 82 mm and less than or equal to 105 mm. In this manner, the nail gun can be ensured to have a certain striking force, a height of the cylinder 13*c* in a longitudinal direction is relatively small, and an efficiency of the cylinder 13*c* can be maintained at an optimal level.

In an example, the cylinder 13*c* may further be provided with a pressure sensor. The nail gun further includes a detection device and an alarm device. The pressure sensor is electrically connected to the detection device, and the detection device can identify and determine a pressure value monitored by the pressure sensor. The alarm device is electrically connected to the detection device. When the air in the cylinder 13*c* is compressed to a to-be-fired state, and the pressure sensor detects that the pressure value is transmitted to the detection device and finds that the pressure value is less than a preset value, the detection device outputs an electrical signal to the alarm device to remind the user that the air in the cylinder 13*c* is in an underpressure state at this time, and the user can stop the machine in time to inflate the cylinder 13*c*. In an implementation, the alarm device may be provided as a display interface showing that the cylinder 13*c* is in a low pressure state. In another implementation, the alarm device may also be provided as an alarm to remind the user that the cylinder 13*c* is in a low pressure state. In fact, the alarm device may be provided as any device with a warning effect or a reminding effect, which is not limited herein. In this implementation, the nail gun is further provided with a stop switch forming an electric connection with the detection device. When the air in the cylinder 13*c* is under pressure, the detection device outputs an electrical signal to the stop switch, and the stop switch automatically controls the nail gun to be turned off. At this time, the nail gun cannot be started. It is to be understood that when the air in the cylinder 13*c* is under pressure, the firing assembly 15*c* cannot output sufficient striking force during the air doing work, resulting in a stronger collision between the firing pin 151*c* and the drive teeth of the drive wheel, and thus resulting in a faster damage of the firing pin 151*c* or the transmission assembly. The nail gun further includes a Hall switch, and the Hall switch is electrically connected to the detection device. The Hall switch can control a driver circuit to cut off, and when the stop switch fails to sense a stop signal, the Hall switch can effectively sense a signal transmitted from the detection device and control the driver circuit to cut off.

Figure 12:
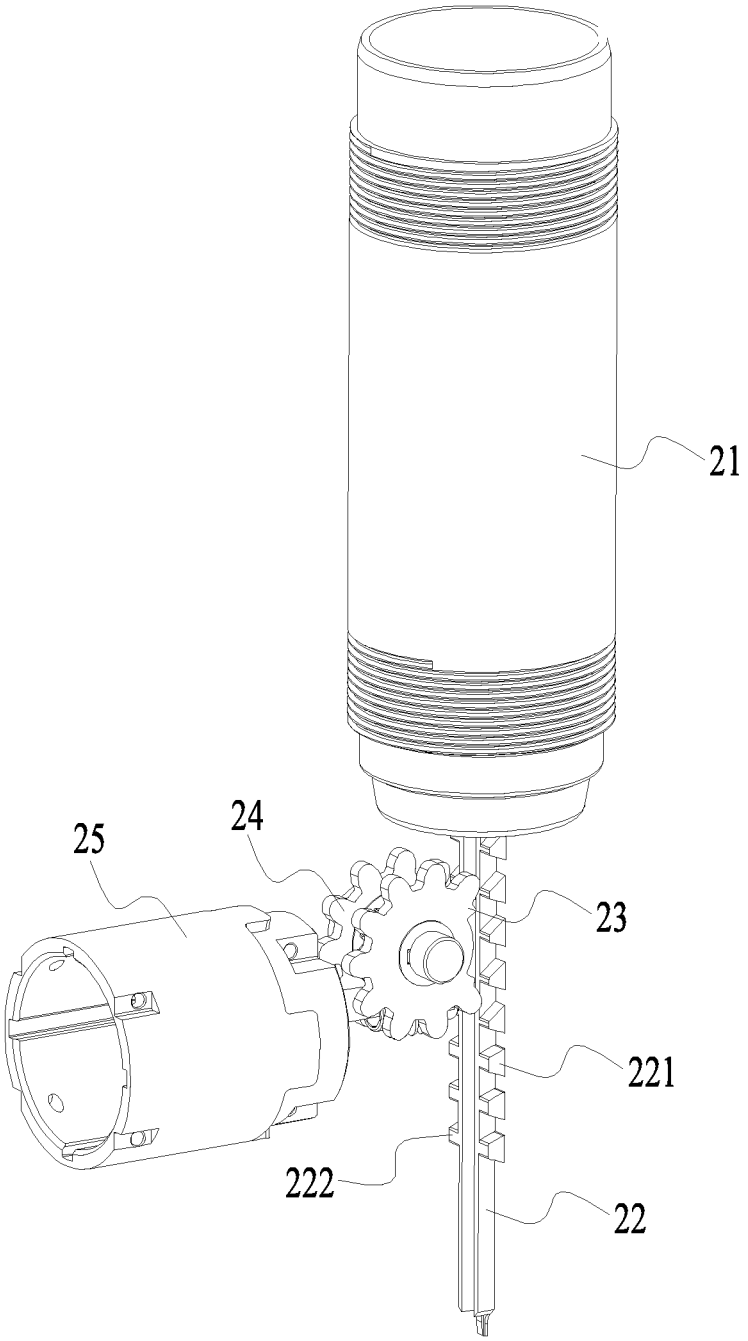
FIG. 12 is a perspective view illustrating a firing assembly as well as a cylinder being engaged with a power output assembly of a nail gun according to a fifth example.
Figure 13:
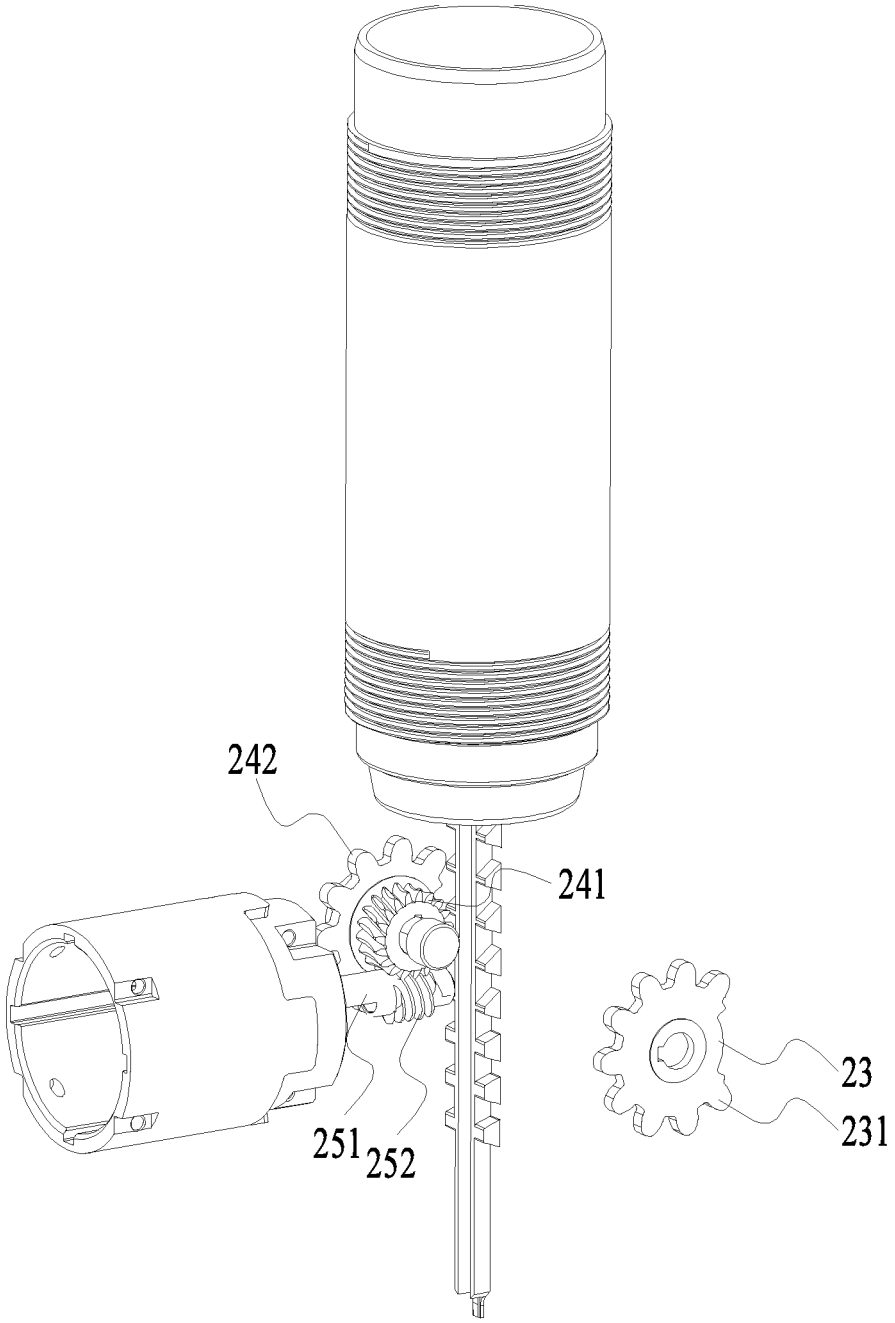
FIG. 13 is a perspective view illustrating that a power output assembly of a nail gun of FIG. 12 is partially exploded.

FIGS. 12 and 13 show a partial structure of a nail gun of the fifth example. The structure of the nail gun of the first example that can be applied to the present example is applied to the present example, which will not be described in detail, and the differences between the present example and the first example will be mainly described below. As shown in FIGS. 12 and 13, the nail gun in this example differs from the nail gun in the first example in that the structure of the firing pin 22 is different. In this example, the firing pin 22 includes first drive teeth 221 and second drive teeth 222, where the first drive teeth 221 and the second drive teeth 222 are substantially symmetrically distributed about a central axis of the firing pin 22. A first drive wheel 23 and a second drive wheel 24 are disposed between the gearbox 25 and the firing pin 22. The first drive wheel 23 is configured to be engaged with the first drive teeth 221, and the second drive wheel 24 is configured to be engaged with the second drive teeth 222. Through the above arrangement, when the firing pin 22 is driven by the drive wheel, a driving force acted on the firing pin 22 is effectively dispersed to the first drive teeth 221 and the second drive teeth 222. In this manner, a wear degree of the first drive teeth 221 and a wear degree of the second drive teeth 222 can be effectively reduced, and a volume of the firing pin 22 can be reduced on this basis, so that the movement of the firing pin 22 is more stable and a nailing effect of the nail gun is better. In fact, the first drive wheel 23 and the second drive wheel 24 are separately disposed perpendicular to an extension plane of the firing pin 22, so that the cylinder 21, the power output assembly and the handle can be all located within a predetermined distance range of a plane. Through the arrangement of a double drive teeth structure, an overall volume of the firing pin 22 is reduced on the premise of maintaining a preset structural strength, and thereby the overall volume of the firing assembly is reduced. On such a premise, the firing assembly can be applied to a cylinder 21 with a smaller size, thereby effectively optimizing a shape of the nail gun, and making the nail gun more convenient for an operator to operate.

More specifically, the first drive wheel 23 includes first transmission teeth and third drive teeth 231, and the second drive wheel 24 includes second transmission teeth 241 and fourth drive teeth 242. The third drive teeth 231 mesh with the first drive teeth 221, and the fourth drive teeth 242 mesh with the second drive teeth 222. The gearbox 25 is further connected to or provided with a drive shaft 251, and the drive shaft 251 is provided with third drive teeth 252 which mesh with the first transmission teeth and the second transmission teeth 241 simultaneously, so as to drive the first drive wheel 23 and the second drive wheel 24 to rotate simultaneously, and the first drive wheel 23 and the second drive wheel 24 simultaneously drive the firing pin 22 to move.

Figure 14:
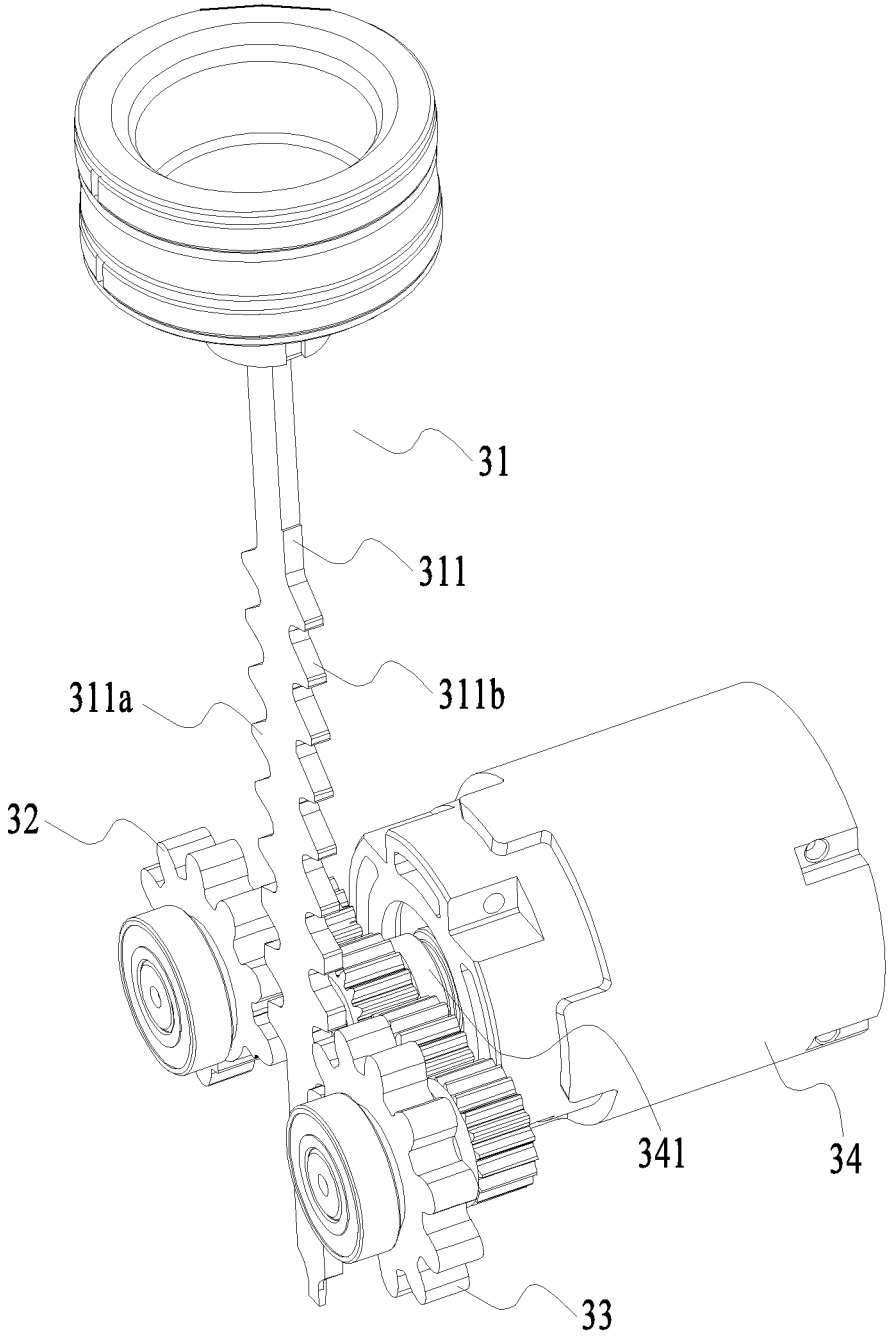
FIG. 14 is a perspective view illustrating a firing assembly as well as a cylinder being engaged with a power output assembly of a nail gun according to a sixth example.

FIG. 14 shows a partial structure of a nail gun of the sixth example. The structure of the nail gun of the first example that can be applied to the present example is applied to the present example, which will not be described in detail, and the differences between the present example and the first example will be mainly described below. As shown in FIG. 14, the nail gun in this example differs from the nail gun in the first example in that the structure of the firing assembly 31 is different and that the transmission structure of the transmission portion is different. In this example, the firing assembly 31 includes a firing pin 311, and the firing pin 311 includes first drive teeth 311*a* and second drive teeth 311*b*, where the first drive teeth 311*a* and the second drive teeth 311*b* are substantially symmetrically distributed about a central axis of the firing pin 311. A first drive wheel 32 and a second drive wheel 33 are disposed between the gearbox 34 and the firing pin 311. The first drive wheel 32 is configured to be engaged with the first drive teeth 311*a*, and the second drive wheel 33 is configured to be engaged with the second drive teeth 311*b*. Through the above arrangement, when the firing pin 311 is driven by the drive wheel, a driving force acted on the firing pin 311 is effectively dispersed to the first drive teeth 311*a* and the second drive teeth 311*b*. In this manner, a wear degree of the first drive teeth 311*a* and a wear degree of the second drive teeth 311*b* can be effectively reduced. In fact, the first drive wheel 32 and the second drive wheel 33 are separately disposed parallel to an extension plane where the firing pin 311 is located, so that the transmission assembly can directly drive the firing pin 311, thereby obtaining a relatively strong driving force and reducing wear of the firing pin 311, the first drive teeth 311*a* and the second drive teeth 311*b*.

More specifically, the gearbox 34 is connected or provided with a drive shaft 341, and the drive shaft 341 drives the first drive wheel 32 and the second drive wheel 33 through a group of external meshing gear assemblies.

Figure 15:
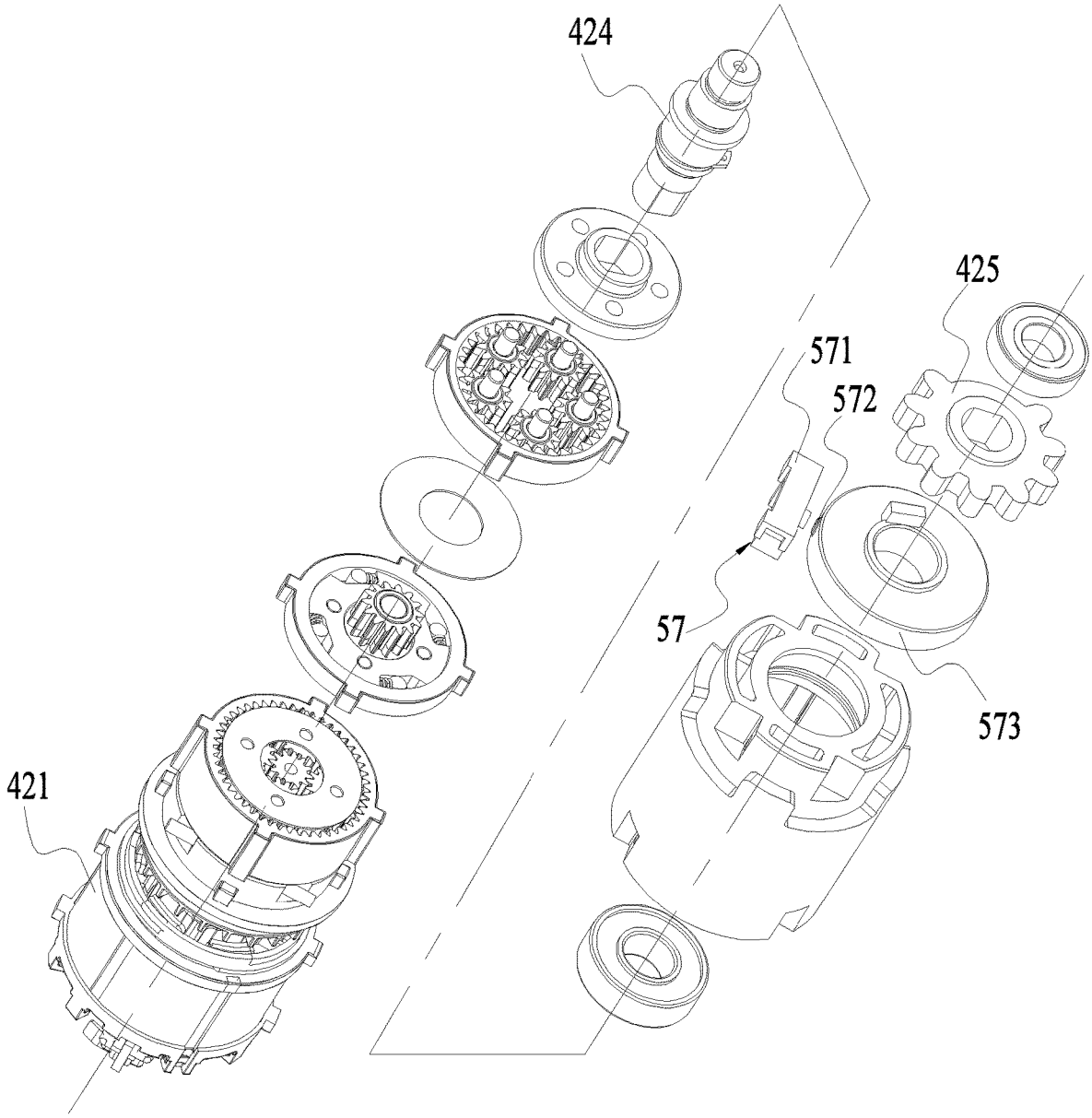
FIG. 15 is an exploded view of a power output assembly of a nail gun according to a seventh example.
Figure 16:
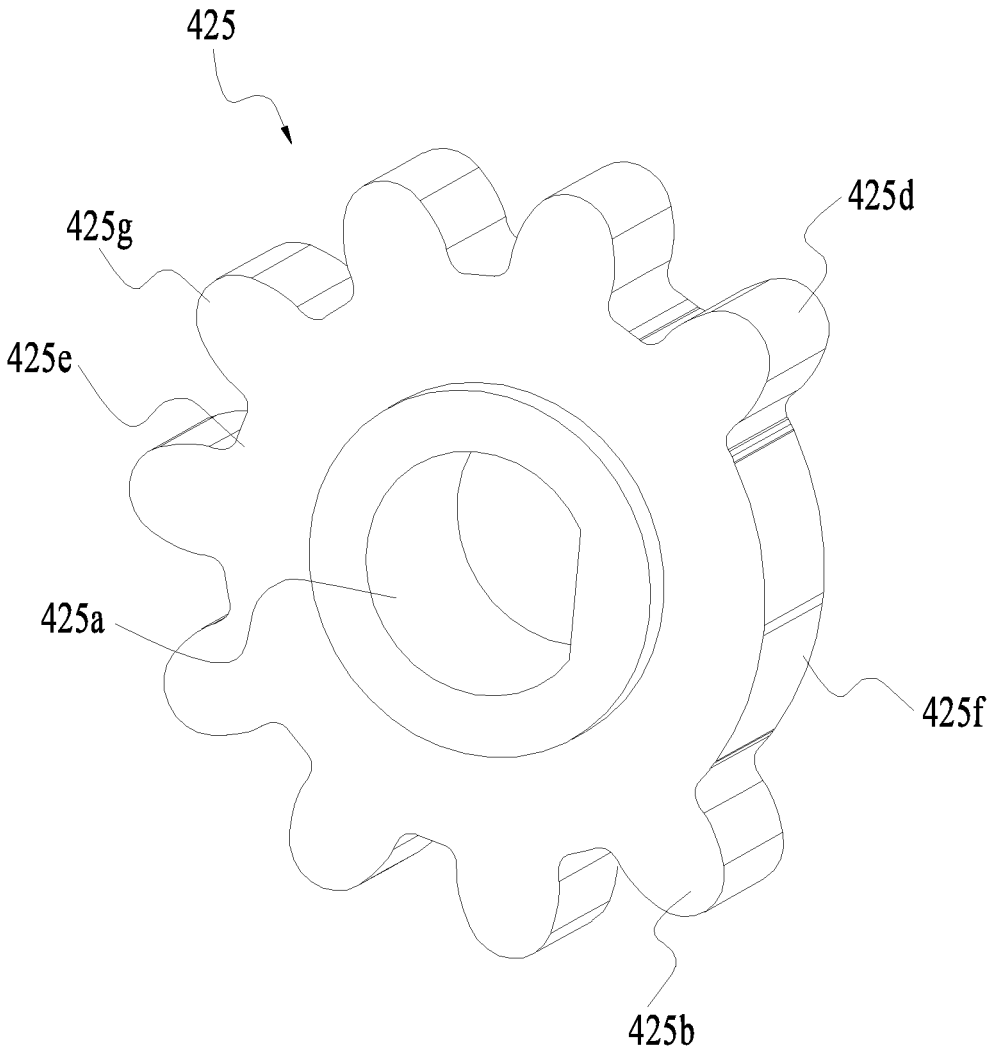
FIG. 16 is a perspective view of a drive wheel of the nail gun of FIG. 15.

FIG. 16 show a partial structure of a nail gun of the seventh example. The structure of the nail gun of the first example that can be applied to the present example is applied to the present example, which will not be described in detail, and the differences between the present example and the first example will be mainly described below. As shown in FIGS. 15 and 16, the drive wheel 425 is a gear structure. The drive wheel 425 is further formed with a second connection hole 425*a* to which the drive shaft 424 is connected. The second connection hole 425*a* is specifically a flat hole, and when the drive shaft 424 is connected to the second connection hole 425*a*, the drive wheel 425 can rotate synchronously with the drive shaft 424. A plurality of drive teeth 425*g* are formed around a main body portion of the drive wheel 425, and the drive teeth 425*g* include a first tooth 425*b* disposed at a starting end of the main body portion and a second tooth 425*d* disposed at a tail end of the main body portion. Here, it is defined that a drive teeth 425*g* first coming into contact with the firing pin in the firing assembly when the drive wheel 425 starts to drive the firing assembly back to an initial position is the first tooth 425*b*, and it is defined that a drive teeth 425*g* last meshing with the firing pin in the firing assembly when the firing assembly is at the initial position is the second tooth 425*d*. A first section 425*e* and a second section 425*f* are included between the first tooth 425*b* and the second tooth 425*d*. A plurality of drive teeth 425*g* are evenly distributed on the first section 425*e*, and the second section 425*f* is smooth and continuous and is not distributed with drive teeth 425*g*. When the drive teeth 425*g* of the first section 425*e* mesh with the transmission tooth of the firing pin, the drive wheel 425 can drive the firing pin to compress the air in the cylinder to do work. When the second section 425*f* cooperates with the firing pin, since the second section 425*f* is smooth and continuous, the firing pin is rapidly pushed out by the air in the cylinder in a case of not blocked by the drive teeth 425*g*, thereby achieving a nailing effect.

Figure 17:
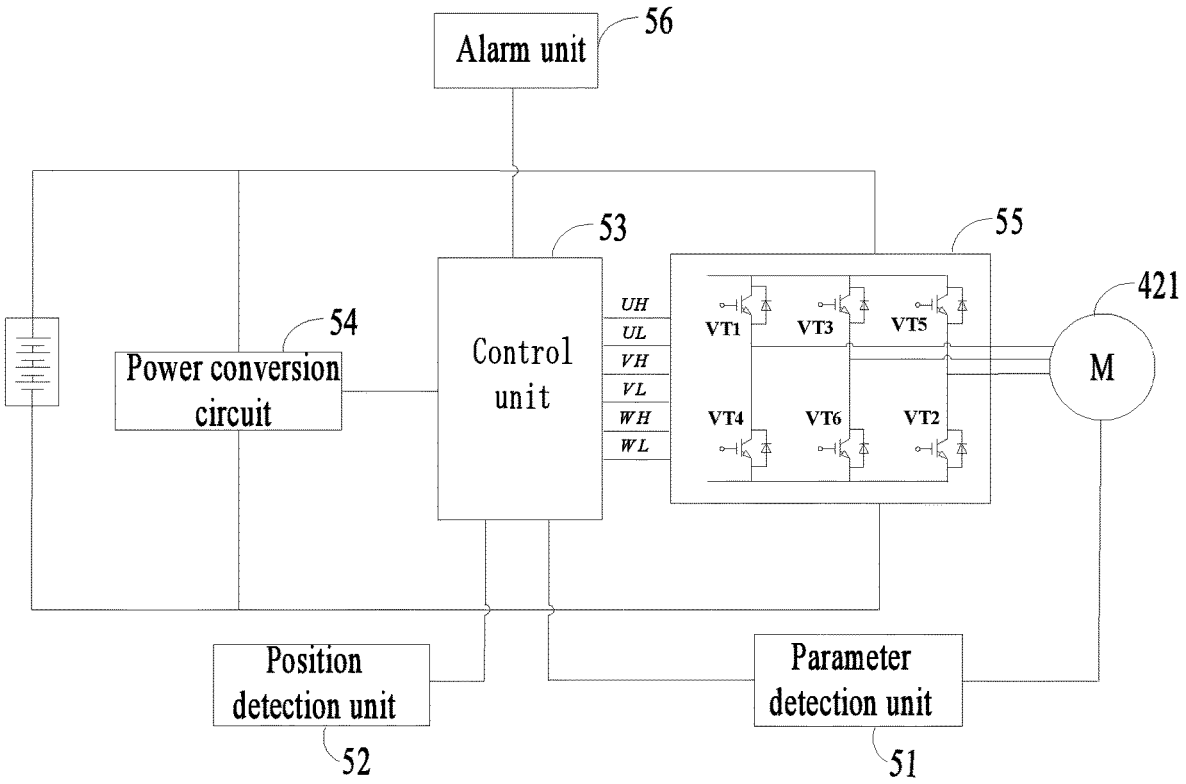
FIG. 17 is a schematic circuit diagram of the nail gun of FIG. 15.

As shown in FIG. 17, a control circuit of the nail gun includes at least a parameter detection unit 51, a position detection unit 52, a control unit 53, a power conversion circuit 54, and a driver circuit 55.

The power conversion circuit 54 is connected to a battery pack 15 and configured to convert output electric energy of the battery pack into a power supply voltage capable of supplying power to a control unit, the parameter detection unit, the position detection unit, and the like.

The driver circuit 55 is connected between the control unit and the motor and can receive a control signal output by the control unit, and the driver circuit 55 changes a conduction state of the driving circuit 55 to control a rotational speed or a rotational direction of a motor. Optionally, the driver circuit may include one or more switching elements. In one example, as shown in FIG. 17, the driver circuit includes a plurality of switching elements, that is, VT1, VT2, VT3, VT4, VT5, and VT6. Gates of the switching elements each are electrically connected to the control unit 53 and are used for receiving the control signal from the control unit 53. Drains or sources of the switching elements each are connected to windings of a stator of the motor 421. The switching elements VT1 to VT6 receive the control signal from the control unit to change their respective conduction states, thereby changing a current applied to the windings of the stator of the motor by the battery pack. In one example, the driver circuit 55 may be a three-phase bridge driver circuit including six controllable semiconductor power devices (such as field effect transistor (FET), bipolar junction transistor (BJT), or insulated-gate bipolar transistor (IGBT)). It is to be understood that the above switching element may also be any other type of solid state switches, such as the insulated-gate bipolar transistor (IGBT) or the bipolar junction transistor (BJT).

To rotate the motor, the driver circuit 55 has a plurality of drive states. In a drive state, the windings of the stator of the motor generate a magnetic field, and the control unit is configured to output a corresponding pulse width modulation (PWM) control signal to the switching elements of the driver circuit according to a rotational position of a rotor of the motor or a counter electromotive force to enable the driver circuit to switch the drive state, so that the windings of the stator generate a changed magnetic field to drive the rotor to rotate, and thus the rotation or the phase-changing of the motor is implemented. It is to be noted that any other circuit and control mode capable of driving the motor to rotate or change phase may be used in the present disclosure, and the present disclosure does not limit a circuit structure of the driver circuit and the control of the driver circuit by the control unit.

The parameter detection unit 51 is configured to detect a relevant parameter in operation of the motor 421 during a nailing process of the nail gun. The relevant parameter in the operation of the motor may refer to an operating time T1 of the motor, the number of turns N1 of the motor, an output voltage or current of the motor, or the like.

The control unit 53 may control the change of the operating state of the motor according to the relevant parameter in the operation of the motor detected by the parameter detection unit 51. Optionally, when the relevant parameter is greater than a first parameter threshold, the control unit 53 may reduce drive power of the motor so that the rotational speed of the motor is reduced and a speed at which the firing assembly moves in a direction of the initial position is also reduced. For example, the control unit may reduce a duty cycle of the output PWM signal to reduce the drive power of the motor. Optionally, when the relevant parameter is greater than the first parameter threshold, the control unit 53 may directly stop driving the motor and cause the motor to enter a freewheeling stage. During the freewheeling stage, the firing assembly continues to move in an initial direction by the rotational inertia of the motor, and the movement speed gradually decreases. In one example, the first parameter threshold is half or about half of a corresponding relevant parameter in one nailing cycle. For example, if the corresponding relevant parameter in one nailing cycle is X, the first parameter threshold is 0.5X or 0.6X. In one implementation, the number of turns or the operating time of the motor serves as the relevant parameter in the operation of the motor. If the number of turns of the motor in one nailing cycle is N2, the first parameter threshold is N2/2, and if the operating time of the motor in one nailing cycle is T2, the first parameter threshold is T2/2. In the present application, a principle for selecting the first parameter threshold is described below. When the relevant parameter in the operation of the motor is consistent with the first parameter threshold, the firing pin has fired the nail and is in a process of moving from a firing position to the initial position. In an implementation, when the parameter detection unit detects that the number of turns N1 of the motor is greater than N2/2, the control unit 53 may reduce the drive power of the motor, thereby reducing the speed at which the firing pin moves toward the initial position. In an implementation, when the parameter detection unit detects that the operating time T1 of the motor is greater than T2/2, the control unit 53 may stop driving the motor and cause the motor to slide by inertia to drive the firing pin to continue to move in the direction of the initial position at a lower and lower speed.

Furthermore, during the movement of the firing pin toward the initial position, the position detection unit 52 may detect a movement position of the firing pin, and when the movement position reaches a preset position, the control unit controls the motor to brake so that the firing pin rapidly reduces a movement speed and finally stops at the initial position. That is, after the motor slides by the inertia for a period of time, the firing pin moves to a position close to the initial position, and the control unit controls the rotational speed of the motor to quickly drop to zero and the firing pin to stop at the initial position. Optionally, the firing pin may also stop at a certain position close to the initial position.

Optionally, the position detection unit may include a sensor such as a Hall sensing assembly or an optoelectronic device capable of detecting the movement position of the firing pin in the cylinder.

In one implementation, the position detection unit 52 is the Hall sensing assembly 57 shown in FIG. 15, and the Hall sensing assembly 57 can detect the position of the firing pin when the firing pin moves in the cylinder. Specifically, the Hall sensing assembly 57 includes a Hall element 571 and a magnetic member 572. The Hall element 571 is disposed at a preset position of the housing, and the magnetic member 572 is disposed at an insulating member 573 parallel to the drive wheel 425, and the insulating member 573 is distributed around the magnetic member 572, so that the magnetic member 572 can be prevented from magnetizing the drive teeth 425*g* and thus affecting the signal receiving of the Hall element 571. It is to be understood that the insulating member 573 is fixedly connected to the drive wheel 425 and can rotate synchronously with the drive wheel 425. When the drive wheel 425 rotates to the preset position, the magnetic member 572 transmits a signal to the Hall element 571, and the Hall element 571 can transmit the signal to the control unit 53. It is to be understood that the control unit 53 can recognize a position of the drive wheel 425 according to the signal transmitted by the Hall element 571 and can also estimate the position of the firing pin moving in the cylinder according to a drive-rotation relationship between the drive wheel and the firing pin in one nailing cycle. For example, when the first tooth 425*b* of the drive wheel is in contact with the firing pin, the firing pin is at the initial position; and when the second tooth 125*d* is in contact with the firing pin, the firing pin is at a firing position, so that the position of the firing pin can be calculated according to the number of teeth of the drive wheel and which tooth is in contact with the firing pin in one nailing cycle.

In one implementation, the position detection unit 52 is the optoelectronic device that can trigger an optoelectronic signal when the firing pin moves to the preset position. When the control unit receives the photoelectric signal, the control unit can determine that the firing pin moves to the preset position, so that the control unit controls the motor to brake and enable the firing pin to quickly reduce the movement speed and finally stop at the initial position. Optionally, the optoelectronic device may be disposed inside or outside the cylinder or at other positions where the movement of the firing pin in the cylinder can be detected.

In this example of the present application, during the period when the motor slides by the inertia, the movement speed of the firing pin is gradually reduced so that the generated kinetic energy is also relatively lower and the corresponding generated heat is also relatively lower; and then the motor is controlled to brake in a case where the motor has a relatively lower speed, so that the rotational speed of the firing pin may be easily reduced to zero, thereby achieving the purpose for accurately controlling a stop position.

In an optional example, if the sensor fails and cannot detect whether the firing pin has reached the preset position, the firing pin may exceed the initial position and continue to move toward an uppermost end of the cylinder, thus causing the nail gun to continuously fire nails and leading to dangers.

In the present application, in order to solve this problem, the control unit 53 can control the motor to brake so as to enable the firing pin to quickly reduce the movement speed until the firing pin stops moving in response to the relevant parameter of the motor being greater than or equal to a second parameter threshold. That is, if the sensor has not fed back whether the firing pin reaches the preset position, the control unit controls the firing pin to stop moving according to the parameters in the operation of the motor. It is to be noted that the second parameter threshold is a value one time or more than one time a corresponding parameter in one nailing cycle. Specifically, if the number of turns of the motor in one nailing cycle is N2, the second parameter threshold is M*N2, and if the operating time of the motor in one nailing cycle is T2, the second parameter threshold is N*T2, where both M and N are positive numbers greater than or equal to 1. For example, the second parameter threshold is N2, 1.3N2, 1.5N2, T2, 1.2T2, 1.4T2, or the like. It is to be understood that when the relevant parameter of the motor is greater than or equal to the second parameter threshold, the firing pin has completed returning from a firing position to the initial position or exceeds the initial position, that is, the firing pin has passed the preset position, but the sensor does not output position information or the position information output by the sensor is not transmitted to the control unit. Therefore, the control unit controls the motor to brake by comparing a relationship between the relevant parameter of the motor and the second parameter threshold, so that the control unit can control the nail gun to stop operating in a case where the sensor fails, thus avoiding occurrence of the danger.

It is to be understood that the above second parameter threshold is greater than the first parameter threshold. For example, the second parameter threshold is 2 times, 2.1 times, 2.2 times, or 2.3 times the first parameter threshold.

In an optional example, the nail gun may further include an alarm unit 56 for outputting alarm information. Specifically, the control unit may stop driving the motor and control the alarm unit 56 to output the alarm information in response to detecting the relevant parameter of the motor being greater than or equal to the second parameter threshold. That is, the control unit 53 can control the motor to brake so as to enable the nail gun to stop operating and give an early warning in a case where the sensor fails, so that the user can perform maintenance in time and continuous nailing and the occurrence of the danger are avoided.

Figure 18:
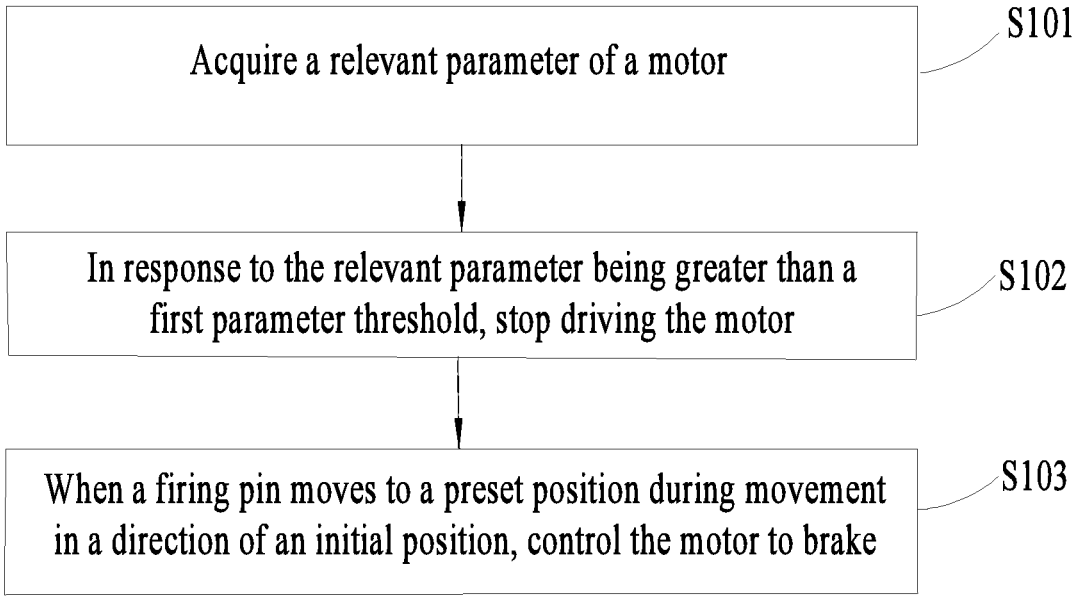
FIG. 18 is a flowchart of a control method of the nail gun of FIG. 15.

A method for controlling a nail gun is described in conjunction with FIG. 18, and the method includes steps described below.

In S101, a relevant parameter of a motor is acquired.

In one nailing cycle, the relevant parameter of the motor may be acquired in real time or based on a certain cycle.

In S102, in response to the relevant parameter being greater than a first parameter threshold, the motor is controlled to reduce drive power.

In S103, when a firing pin moves to a preset position during movement in a direction of an initial position, the motor is controlled to brake.

It is to be understood that after the motor is powered off, the motor continues to slide and rotate due to the inertia and drives the firing pin to continue to move in the direction of the initial position. In this process, whether the firing pin reaches the preset position can be monitored; and if yes, the motor is directly controlled to brake such that the motor quickly stop rotation, so that the firing assembly stops at a certain position. For example, the firing assembly stops at the initial position or near the initial position.

In an optional implementation, if the relevant parameter of the motor is greater than or equal to a second parameter threshold, the motor is controlled to brake. It is to be understood that the braking of the motor is a process in which the rotational speed rapidly drops to zero, and the movement speed of the firing pin also rapidly drops to zero, that is, the firing pin quickly stops when the motor brakes.

The above illustrates and describes basic principles, main features and advantages of the present disclosure. It is to be understood by those skilled in the art that the above examples do not limit the present disclosure in any form, and technical solutions obtained by means of equivalent substitution or equivalent transformation are intended to fall within the scope of the appended claims.

What is claimed is:

1. A nail gun, comprising:

a housing;

a power output assembly at least partially disposed in the housing;

a cylinder at least partially disposed in the housing; and a firing pin configured to perform a nailing operation, wherein the firing pin is provided with a plurality of first drive teeth capable of being driven, the plurality of first drive teeth comprises a locking tooth provided with a rotating shaft, the rotating shaft is provided with a roller wheel, and the roller wheel is rotatable about a rotating axis, and the plurality of first drive teeth further comprises at least one fixed tooth that is not movable relative to the firing pin, and wherein the nail gun comprises an additional roller wheel and the roller wheel and the additional roller wheel are respectively arranged on two sides of the locking tooth.

2. The nail gun of claim 1, wherein a radius of the first roller wheel is greater than or equal to a length of a connecting line between a tooth crest of the locking tooth and an axis center of the rotating shaft.

3. The nail gun of claim 1, wherein the rotating shaft is rotatably connected to the locking tooth and the first roller wheel is fixedly connected to the rotating shaft and capable of rotating with the rotating shaft synchronously.

4. The nail gun of claim 1, wherein the rotating shaft is rotatably connected to the locking tooth and the first roller wheel is rotatably connected to the rotating shaft and capable of rotating with the rotating shaft.

5. The nail gun of claim 1, wherein the rotating shaft is fixedly connected to the locking tooth, and the first roller wheel is rotatably connected to the rotating shaft and capable of rotating about the rotating shaft.

6. The nail gun of claim 1, wherein the power output assembly has a first symmetry plane, the cylinder has a second symmetry plane, the first symmetry plane is substantially parallel to the second symmetry plane, and a distance between the first symmetry plane and the second symmetry plane is greater than or equal to 0 and less than or equal to 15 mm.

7. The nail gun of claim 6, wherein the power output assembly comprises a motor and a gearbox, the motor is configured to output a driving force to the gearbox, the gearbox is provided with a drive shaft capable of driving the firing pin to move, the nail gun further comprises a drive member disposed between the firing pin and the drive shaft, the drive member comprises a second plurality of drive teeth for engaging with the plurality of first drive teeth of the firing pin, and the second plurality of drive teeth extends in an extension plane parallel to or coincident with the first symmetry plane.

8. The nail gun of claim 7, wherein a distance between the extension plane and the first symmetry plane is greater than or equal to 0 and less than or equal to 10 mm.

9. The nail gun of claim 1, wherein a radius of the cylinder is configured to be greater than or equal to 21 mm and less than or equal to 24 mm and a volume of the cylinder is configured to be greater than or equal to 180 ml and less than or equal to 260 ml.

10. The nail gun of claim 1, wherein the firing pin comprises a piston disposed in the cylinder and a stroke of the piston in the cylinder is greater than or equal to 82 mm and less than or equal to 105 mm.

11. The nail gun of claim 1, wherein the rotating axis is perpendicular an extension direction of the firing pin.

12. The nail gun of claim 1, wherein the nail gun further comprises a drive member disposed between the firing pin and the power output assembly and the drive member comprises a plurality of second drive teeth for engaging with the plurality of first drive teeth of the firing pin.

13. The nail gun of claim 12, wherein the drive member further comprises a release portion for releasing the firing pin to allow the firing pin to move and the release portion and the plurality of second drive teeth are disposed on a circumference of the drive member.

14. A nail gun, comprising:

a housing formed with a first accommodating space and a second accommodating space;

a power output assembly at least partially disposed in the first accommodating space;

a cylinder at least partially disposed in the second accommodating space;

a firing pin configured to perform a nailing operation in a nailing direction; and a drive member configured to drive the firing pin;

wherein the firing pin is provided with a plurality of first drive teeth capable of being driven and a rotating shaft provided with a first roller wheel, the plurality of first drive teeth are incapable of rotating relative to a body portion of the firing pin in which the first drive teeth extend from, the first roller wheel is capable of rotating about a rotating axis and is set lower than the plurality of the first drive teeth in the nailing direction, and the drive member comprises a second plurality of drive teeth capable of being engaged with the first roller wheel, and wherein the nail gun comprises a second roller wheel, and the first roller wheel and the second roller wheel are respectively arranged along the rotating axis.

15. The nail gun of claim 14, wherein the nail gun further comprises a connecting base connected to the cylinder, the connecting base is provided with a first through hole through which the firing pin passes and exhaust ports for discharging gas, and the exhaust ports are distributed around the connecting base.

16. The nail gun of claim 15, wherein the cylinder and the connecting base are connected to each other such that a first space and a second space capable of being divided into by a piston are formed and the exhaust ports are disposed in the second space.

17. The nail gun of claim 14, wherein the plurality of first drive teeth comprise a locking tooth and a radius of the first roller wheel is greater than or equal to a length of a connecting line between a tooth crest of the locking tooth and an axis center of the rotating shaft.

18. The nail gun of claim 14, wherein the drive member is configured to rotate about an axis parallel to the rotating axis and the rotating axis is perpendicular an extension direction of the firing pin.

19. A nail gun, comprising:

a housing;

a power output assembly at least partially disposed in the housing;

a cylinder at least partially disposed in the housing; and a firing pin configured to perform a nailing operation in a nailing direction;

wherein the firing pin is provided with a plurality of first drive teeth capable of being driven, the plurality of first drive teeth comprises a locking tooth provided with a rotating shaft extending from a surface of the locking tooth, the rotating shaft is provided with a roller wheel, and the roller wheel is rotatable about a rotating axis, and the plurality of first drive teeth further comprises at least one fixed tooth that is not movable relative to the firing pin, and wherein the roller wheel is set lower than the plurality of the first drive teeth in the nailing direction.

* * * * *